US008594358B2

(12) United States Patent
Litovsky et al.

(10) Patent No.: US 8,594,358 B2
(45) Date of Patent: Nov. 26, 2013

(54) PASSIVE ACOUSTICAL RADIATING

(75) Inventors: Roman N. Litovsky, Newton, MA (US); Hal Greenberger, Natick, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 13/224,466

(22) Filed: Sep. 2, 2011

(65) Prior Publication Data

US 2012/0051573 A1 Mar. 1, 2012

Related U.S. Application Data

(60) Division of application No. 11/463,325, filed on Aug. 9, 2006, now Pat. No. 8,031,896, which is a continuation of application No. 10/623,996, filed on Jul. 21, 2003, now Pat. No. 7,133,533.

(51) Int. Cl.

| | |
|---|---|
| ***H04R 1/20*** | (2006.01) |
| ***H04R 1/28*** | (2006.01) |
| *H04R 1/34* | (2006.01) |
| *H04R 1/24* | (2006.01) |

(52) U.S. Cl.

CPC ..... *H04R 1/2826* (2013.01); *H04R 1/345* (2013.01); *H04R 1/24* (2013.01)

USPC ..... 381/349; 381/160; 381/182

(58) Field of Classification Search

USPC ..... 381/89, 160, 162, 182, 186, 335, 349, 381/386, 389; 181/144, 145, 147, 199

See application file for complete search history.

(56) References Cited

U.S. PATENT DOCUMENTS

| | | | |
|---|---|---|---|
| 1,988,250 | A | 1/1935 | Olson |
| 4,146,111 | A | 3/1979 | Mae et al. |
| 4,332,986 | A | 6/1982 | Butler |
| 4,598,789 | A | 7/1986 | Ritter |
| 5,150,418 | A | 9/1992 | Honda et al. |
| 5,749,433 | A | 5/1998 | Jackson |
| 5,850,460 | A | 12/1998 | Tanaka et al. |
| 6,044,925 | A | 4/2000 | Sahyoun |
| 6,356,642 | B1 | 3/2002 | Nakamura et al. |
| 6,628,792 | B1 | 9/2003 | Paddock |
| 6,782,112 | B1 | 8/2004 | Geddes |
| 7,133,533 | B2 | 11/2006 | Chick et al. |
| 2004/0131219 | A1 | 7/2004 | Polk, Jr. |
| 2004/0218778 | A1 | 11/2004 | Weisman |
| 2005/0018868 | A1 | 1/2005 | Chick et al. |
| 2005/0129258 | A1 | 6/2005 | Fincham |
| 2006/0078136 | A1 | 4/2006 | Stiles et al. |
| 2006/0291684 | A1 | 12/2006 | Chick et al. |
| 2007/0201712 | A1 | 8/2007 | Saiki |

FOREIGN PATENT DOCUMENTS

| | | | |
|---|---|---|---|
| EP | 0778720 | A1 | 6/1997 |
| EP | 1791389 | A1 | 5/2007 |
| JP | 50-039123 | A | 4/1975 |
| JP | 56002690 | A | 1/1981 |

(Continued)

OTHER PUBLICATIONS

Examination Report dated Nov. 29, 2008 from Government of India Patent Office for related IN Appl. No. 93/DELNP?2006.

(Continued)

*Primary Examiner* — Tuan D Nguyen

(74) *Attorney, Agent, or Firm* — Bose Corporation

(57) ABSTRACT

An audio device has passive radiators that are driven by acoustic drivers. The passive radiators are arranged so that the net mechanical vibration is minimized.

12 Claims, 27 Drawing Sheets

(56) References Cited

FOREIGN PATENT DOCUMENTS

| | | | |
|---|---|---|---|
| JP | 59207796 | A | 11/1984 |
| JP | 60142593 | A | 7/1985 |
| JP | 60-177798 | A | 9/1985 |
| JP | 62001490 | A | 1/1987 |
| JP | 62-164124 | A | 7/1987 |
| JP | 63-286096 | A | 11/1988 |
| JP | 01-067897 | A | 3/1989 |
| JP | 02-301395 | A | 12/1990 |
| JP | 3-108999 | A | 5/1991 |
| JP | 4117098 | A | 4/1992 |
| JP | 4-192795 | A | 7/1992 |
| JP | 8019083 | A | 1/1996 |
| JP | 08079876 | A | 3/1996 |
| JP | 11205884 | A | 7/1999 |
| WO | 01/62043 | A1 | 8/2001 |
| WO | 2006030760 | A1 | 3/2006 |

OTHER PUBLICATIONS

International Preliminary Report on Patentability dated Jun. 4, 2009 for PCT/US2007/085352.
Office Action for JP Appl. No. 2006-521203 dated Jul. 7, 2009.
Office Action dated Jul. 8, 2008 for JP2006-521203.
ISRWO dated Feb. 8, 2006 for PCT/US2004/023408.
IPRP dated Mar. 23, 2006 for PCT/US2004/023408.
Examination Report dated Sep. 8, 2008 for EP 04778762.7.
Supplemental Search Report dated Jun. 25, 2008 for EP 04778762.7.
ISRWO dated May 8, 2008 for PCT/US2007/085352.
Office Action dated Nov. 4, 2009 for Jp 2006-521203.
EP OA dated Jan. 11, 2010 for EP 04778762.7-2225.
CN OA dated Jun. 9, 2010 for CN Appl. No. 200480020977.4.
CN Office Action dated Dec. 2, 2010 for CN 200480020977.4.
Extended European Search Report dated Feb. 29, 2012 for EP Application No. 10178152.4-2225.
CN Office Action dated Mar. 31, 2012 for CN Application No. 200480020977.4.
Fifth CN OA dated Apr. 3, 2013 for CN Appl. No. 200480020977.4.

PASSIVE ACOUSTICAL RADIATING

CROSS-REFERENCE TO RELATED APPLICATIONS

This application is a Divisional of, and claims priority to, U.S. patent application Ser. No. 10/623,996 now U.S. Pat. No. 7,133,533, filed Jul. 21, 2003 which is a Divisional of, and claims priority to, U.S. patent application Ser. No. 11/463,325, now U.S. Pat. No. 8,031,896, filed Aug. 9, 2006, both incorporated by reference in their entirety.

BACKGROUND OF THE INVENTION

The invention relates to acoustic radiating devices and more particularly to acoustic radiating devices including passive acoustic radiators.

It is an important object of the invention to provide an acoustic radiating device including passive radiators that vibrates less.

BRIEF SUMMARY OF THE INVENTION

According to the invention, an acoustic device includes an acoustic enclosure having an exterior surface and enclosing an interior volume and further having an aperture in the exterior surface; a first acoustic driver and a second acoustic driver, each having a first radiating surface, mounted so that the first radiating surface faces the enclosure interior volume. The acoustic device also includes a passive radiator module, including a closed three dimensional structure defining a cavity with an opening, mounted in the aperture to define a cavity in the enclosure, separated from the interior volume. The device also includes a first passive radiator and a second passive radiator, each having a radiating element having two opposing surfaces, mounted in the module so that one of the surfaces faces the cavity; and a baffle structure in the enclosure, acoustically isolating the first acoustic driver and the first passive radiator from the second acoustic driver and the second passive radiator In another aspect of the invention, a module for use in an acoustic enclosure includes a closed three dimensional structure defining a cavity with an opening and a first passive radiator having a vibratile element having a first and a second surface. The vibratile element has an intended direction of vibration. The first passive radiator is mounted in the structure so that the first surface faces the cavity. The first passive radiator is characterized by a mass and a surface area. The module also includes a second passive radiator having a vibratile element having a first and a second surface and having an intended direction of vibration. The second passive radiator is mounted in the structure so that the first surface faces the cavity. The second passive radiator is characterized by a mass and a surface area. The first passive radiator and the second passive radiator are further positioned so that the first passive radiator intended direction of vibration and the second passive radiator intended directions of vibration are substantially parallel.

In another aspect of the invention, an acoustic device includes an acoustic enclosure bounded by a three dimensional bounding figure. The enclosure has walls defining an enclosure interior volume. There is a cavity in the acoustic enclosure, separated from the interior volume by one of the walls, and lying substantially within the bounding figure. The device also includes a first passive radiator having a first surface and an opposing second surface and an intended direction of vibration, mounted in the one wall so that the passive radiator first surface faces the cavity and the passive radiator second surface faces the enclosure interior.

In another aspect of the invention, an acoustic device includes an acoustic enclosure having an interior. The device also includes a first passive acoustic radiator, mounted in the acoustic enclosure, having a vibratile element having an intended direction of vibration. The device also includes a second passive acoustic radiator, mounted in the acoustic enclosure, having a vibratile element having an intended direction of vibration. The device also includes a first acoustic driver, mounted in the acoustic enclosure, having a vibratile element having an intended direction of vibration, connectable to a source of an audio signal to cause the first acoustic driver vibratile element to vibrate responsive to the audio signal to radiate first acoustic energy into the enclosure interior to cause the first passive acoustic radiator vibratile element to vibrate to radiate second acoustic energy. The device also includes a second acoustic driver, mounted in the acoustic enclosure, having a vibratile element having an intended direction of vibration parallel to the first acoustic driver vibratile element intended direction of vibration. The second acoustic driver is connectable to the source of audio signals to cause the second acoustic driver vibratile element to vibrate responsive to the audio signal, mechanically out of phase with the first acoustic driver vibratile element, to radiate, acoustically in phase with the first acoustic energy, third acoustic energy to cause the second passive acoustic radiator vibratile element to vibrate, mechanically out of phase with the first passive radiator vibratile element, to radiate fourth acoustic energy, in phase with the second acoustic energy.

In another aspect of the invention, an acoustic device includes an acoustic enclosure having an interior; a first acoustic driver and a second acoustic driver, mounted in the enclosure; a first passive radiator and a second passive radiator, mounted in the enclosure; and a baffle structure, in the enclosure, acoustically isolating the first acoustic driver and the first passive radiator from the second acoustic driver and the second passive radiator.

In another aspect of the invention, an acoustic device includes an acoustic enclosure having an interior and an exterior. The acoustic driver has a motor structure, mounted in the enclosure so that the acoustic driver radiates acoustic energy to the interior and the exterior. The device also has a passive radiator having two faces, mounted in the acoustic enclosure so that the passive radiator, responsive to the acoustic energy radiated to the interior, vibrates to radiate acoustic energy to the exterior. The acoustic driver is mounted so that the motor structure is outside the enclosure.

In another aspect of the invention, an acoustic device includes an acoustic enclosure, having an interior and an exterior. An acoustic driver is mounted in the enclosure so that the acoustic driver radiates acoustic energy to the interior. The device also includes a plurality greater than two of passive radiators mounted in the enclosure. Each of the passive radiators vibrates responsive to the acoustic energy radiated to the interior. The vibrating of each of the passive radiators is characterized by an intended direction of motion and a force. The passive radiators are constructed and arranged so that the sum of the forces is less than any one of the forces.

In another aspect of the invention, an acoustic device includes an acoustic enclosure, enclosing a volume of air. A first passive radiator having a vibratile surface is mounted in a wall of the acoustic enclosure. A first plurality of acoustic drivers is for radiating acoustic energy into the acoustic enclosure so that the acoustic energy interacts with the volume of air to cause the vibratile surface to vibrate. The plurality of acoustic drivers are positioned symmetrically relative to the passive radiator.

In another aspect of the invention, an acoustic device includes an acoustic enclosure. An acoustic driver is mounted in the acoustic enclosure. A first passive radiator and a second passive radiator are mounted in the acoustic enclosure so that the first passive radiator and the second passive radiator are driven mechanically out of phase with each other by the acoustic driver. The device has mounting elements for mechanically coupling the acoustic enclosure to a structural component.

In still another aspect of the invention, an acoustic device includes a first acoustic enclosure. The device further includes a first acoustic driver, mounted inside the first enclosure. A first passive radiator is mounted in the acoustic enclosure so that the first passive radiator is caused to vibrate in a first direction by the first acoustic driver. The device also includes a second acoustic enclosure. A second acoustic driver is mounted inside the second enclosure. A second passive radiator is mounted in the acoustic enclosure so that the second passive radiator is caused to vibrate in a second direction by the second acoustic driver. There is a mechanical coupling structure for coupling the first acoustic enclosure and the second acoustic enclosure so that the first direction and the second direction are parallel, and so that vibration of the first passive radiator and vibration of the second passive radiator are mechanically out of phase.

Other features, objects, and advantages will become apparent from the following detailed description, when read in connection with the accompanying drawing in which:

DETAILED DESCRIPTION

Figure 1A:
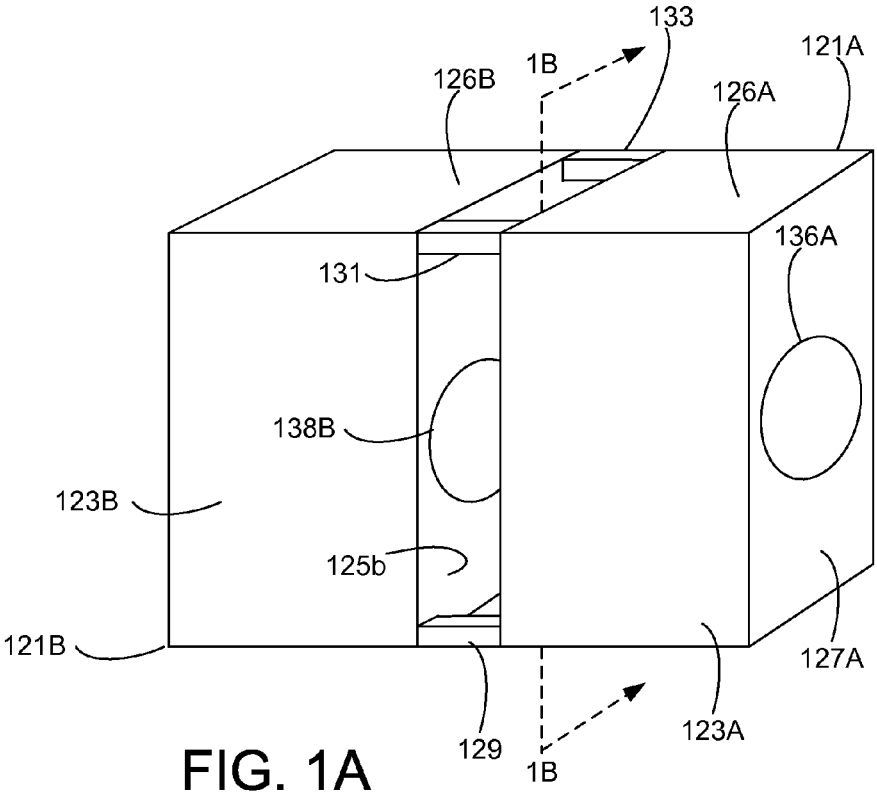
FIGS. 1A and 1B are views an audio device according to the invention.

With reference now to the drawings and more particularly to FIG. 1A, there is shown an isometric view of an audio device according to the invention. A first acoustic enclosure 121A is enclosed by surfaces including sides 123A and 127A and top 126A. There may be other bounding surfaces such as a bottom and other sides such as side 125A, not visible in this view. Mounted in side 127A is an acoustic driver 136A, which is mounted so that one radiating surface faces into enclosure 121A. A second enclosure 121B is enclosed by surfaces including sides 123B and 125B and top 126B. There may be other bounding surfaces, such as a bottom and other sides such as side 127B, not visible in this view. Mounted in side 125B is a passive radiator 138B, which is mounted so that one surface faces into enclosure 121B. Enclosures 121A and 121B are coupled by mechanical couplings 129, 131, and 133, and may be mechanically coupled by other elements not shown in this view. The audio device may also include additional acoustic drivers and passive radiators that will be presented in subsequent views.

Figure 1B:
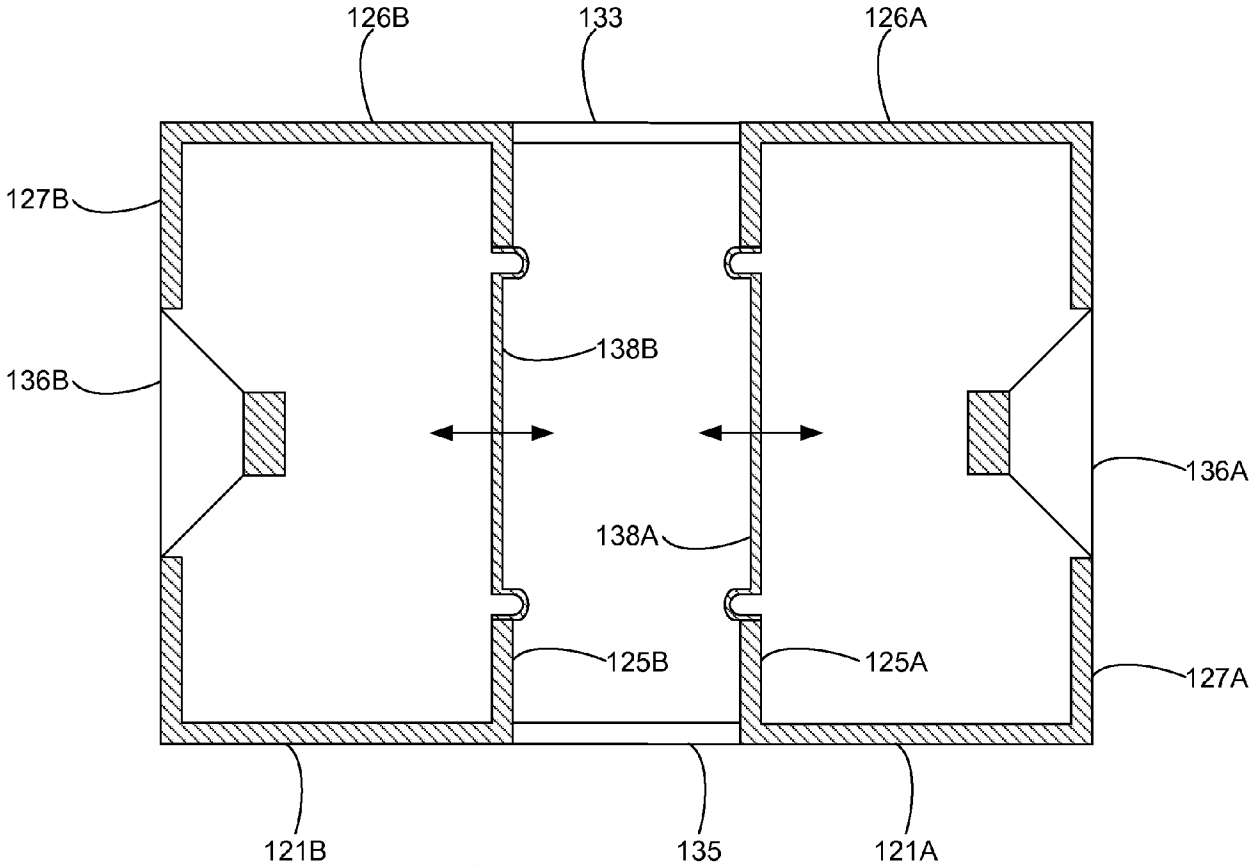

Referring now to FIG. 1B, there is shown a cross-sectional view of the acoustic device of FIG. 1A, taken along line 1B-1B of FIG. 1A. FIG. 1B shows some elements not visible in the view of FIG. 1A. A second acoustic driver 136B is mounted in side 127B of acoustic enclosure 121B. A second passive radiator 138A is mounted in side 125A. The two enclosures and the mechanical couplings are configured so that the directions of motion, indicated by the arrows, of passive radiators 138A and 138B, of the two acoustic drivers have a significant parallel component and are preferably substantially parallel (which, as used herein includes coincident), so that the surfaces are substantially parallel to each other, and preferably so that the two passive radiators are coaxial. For best results, the passive radiators have substantially the same mass and surface area, as will be explained below. The acoustic drivers 136A and 136B are coupled to a source of audio signals, not shown in this view, with a monaural bass spectral component. The frequency range aspect of the invention will be described more fully below. The two acoustic enclosures are further dimensioned and positioned so that when the two acoustic drivers are driven by a common audio signal, the acoustic drivers cause the passive radiators to vibrate acoustically in phase with each other and mechanically out of phase with each other. One arrangement that results in the passive radiators vibrating acoustically in phase with each other and mechanically out of phase with each other is for the two acoustic enclosures, the two acoustic drivers, and the two passive radiators to be substantially identical, and for the exterior surfaces of the two passive radiators to face each other.

Figure 2A:
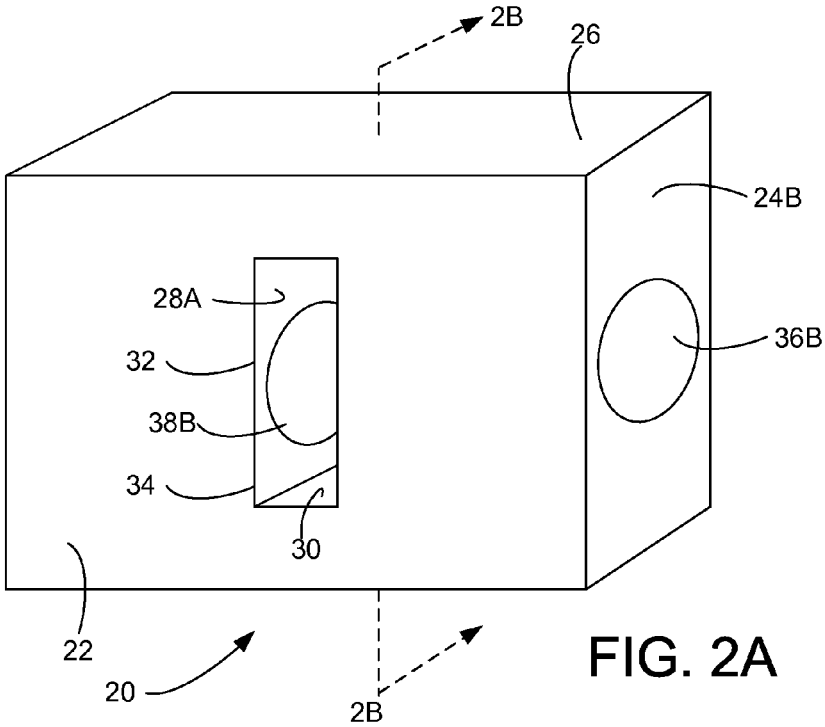
FIGS. 2A and 2B are views of a second audio device according to the invention.

FIG. 2A shows an isometric view of a second acoustic device incorporating the invention. An acoustic enclosure 20 enclosing an internal volume is enveloped by a three dimensional bounding figure in the form of a polyhedron, a cylinder, a portion of a sphere, a conic section, a prism, or an irregular figure enclosing a volume. In the example of FIG. 1, the bounding figure is a right hexahederon, or box-shaped structure. The enclosure is defined by exterior surfaces including side 24B and top 26 that are congruent with the surface of the hexahedron. There may be other exterior surfaces such as a bottom, a back, or a second side, not visible in this view. A surface of enclosure 20, such as front 22 may include an aperture to a cavity 32, defined by a cavity wall structure including surfaces 28A and 30 and other cavity surfaces not shown in this view. The cavity lies substantially within the bounding figure, and is separated from the interior of the enclosure by the cavity wall structure. The wall structure may consist of a combination of planar walls or one or more curved walls, or both. Cavity 32 may be configured so that there is one opening 34 from the external environment to the cavity, or be configured so that there are two or more openings from the external environment to the cavity. Acoustic driver 36B may be positioned so that one of the radiating surfaces of the cone radiates into enclosure 20. Passive radiator 38A is positioned so that one surface faces cavity 32 and one surface faces the interior of enclosure 20. There may be additional acoustic drivers and passive radiators not shown in this view. The several views, except for FIGS. 8A-8D, show the functional interrelationships of the elements and are not drawn to scale.

Figure 2B:
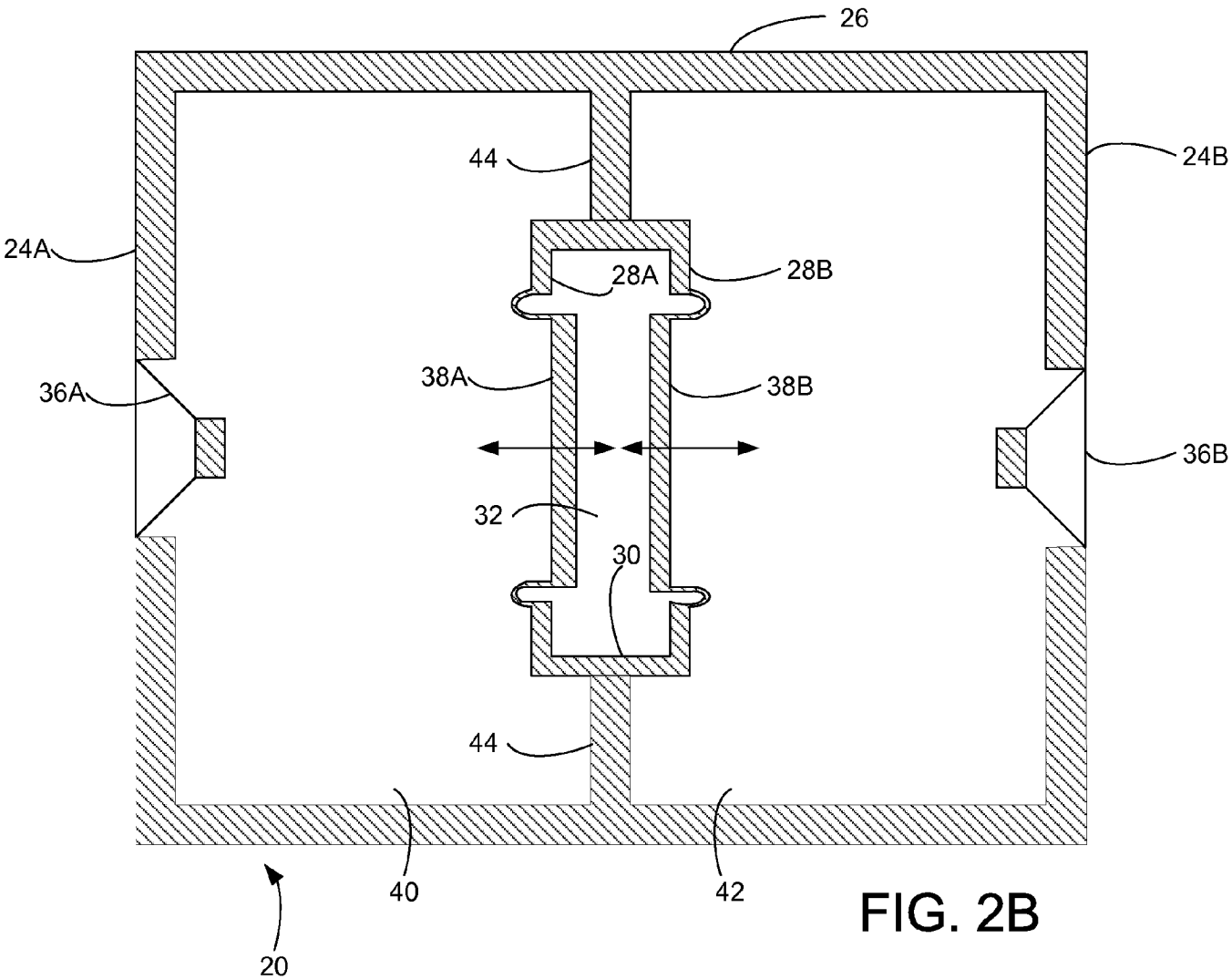

Referring now to FIG. 2B, there is shown a cross-sectional view of the audio device of FIG. 2A, taken along line 2B-2B of FIG. 2A. In addition to the elements shown in FIG. 2A, this view shows a second acoustic driver 36A, in this example mounted in the side 24A, opposite first acoustic driver 36B. This view also shows a second passive radiator 38B positioned so that one surface faces the interior of the enclosure and one surface faces the cavity 32. Second passive radiator 38B may be positioned so that the direction of motion, as indicated by the arrows, of the two acoustic drivers have a significant parallel component and are preferably substantially parallel (which, as used herein includes coincident), so that the surfaces facing the cavity are substantially parallel to each other and transverse to the enclosure aperture, and preferably so that the two passive radiators are coaxial. For best results, the passive radiators have substantially the same mass and surface area, as will be explained below. Additionally, FIG. 2B shows a baffle structure 44 that acoustically isolates a first chamber 40 that contains the first acoustic driver 36A and first passive radiator 38A from a second chamber 42 containing the second acoustic driver 36B and second passive radiator 38B. The acoustic drivers 36A and 36B are coupled to a source of audio signals, not shown in this view, with a monaural bass spectral component. The frequency range aspect of the invention will be described more fully below. In this embodiment, cavity 32 and cavity opening 34 (and other cavity openings, if present) are sized so that they have a minimal acoustic effect on acoustic energy radiated into cavity 32. In other embodiments, cavity 32 and cavity opening 34 may be sized so that they act as an acoustic element, such as an acoustic filter.

Enclosures 20, 121A, and 121B, baffle structure 44, and cavity surfaces such as front 22, sides 24A and 24B, top 26, sides 123B, 123*b*, 125A, 125B, 127A, 127B, and cavity surfaces 28A, 28B, and 30 and other cavity surfaces not visible in the previous views may be made of conventional material suitable for loudspeaker enclosures. Particle board, wood laminates, and various rigid plastics are suitable. Mechanical couplings 131, 133, and 135 may be of a rigid material and may be integrated with one or both of acoustic enclosures 121A and 121B. Acoustic drivers 136A, 136B, 36A and 36B may be conventional acoustic drivers, such as cone type acoustic radiators movably coupled to a support structure by a suspension system and to a force source, such as a linear motor, with characteristics suitable for the intended use of the audio device. The suspension and the force source are configured so that the cone vibrates in an intended direction and so that the suspension opposes cone motion transverse to the intended direction of motion. Passive radiators 138A, 138B, 38A and 38B may also be conventional, such as a rigid planar structure and a mass element, supported by a "surround," or suspension, that permits motion of the planar structure in an intended direction of motion and opposes motion in directions transverse to the intended direction. The rigid planar structure may be, for example, a honeycomb structure, with an added mass element, such as an elastomer, or the rigid planar structure and the mass element may be a unitary structure, such as a metal, wood laminate, or plastic plate.

The acoustic device of FIGS. 1A and 1B and the acoustic device of FIGS. 2A and 2B share some features, including passive radiators with parallel, preferably coaxial, directions of motion driven acoustically in phase with each other and mechanically out of phase with each other, mounted so that they are mechanically coupled to a common structure and facing each other. The operation of the device will be explained below with reference to the device of FIGS. 2A and 2B, it being understood that the principles of the invention can be applied to the device of FIGS. 1A and 1B.

Figure 3A:
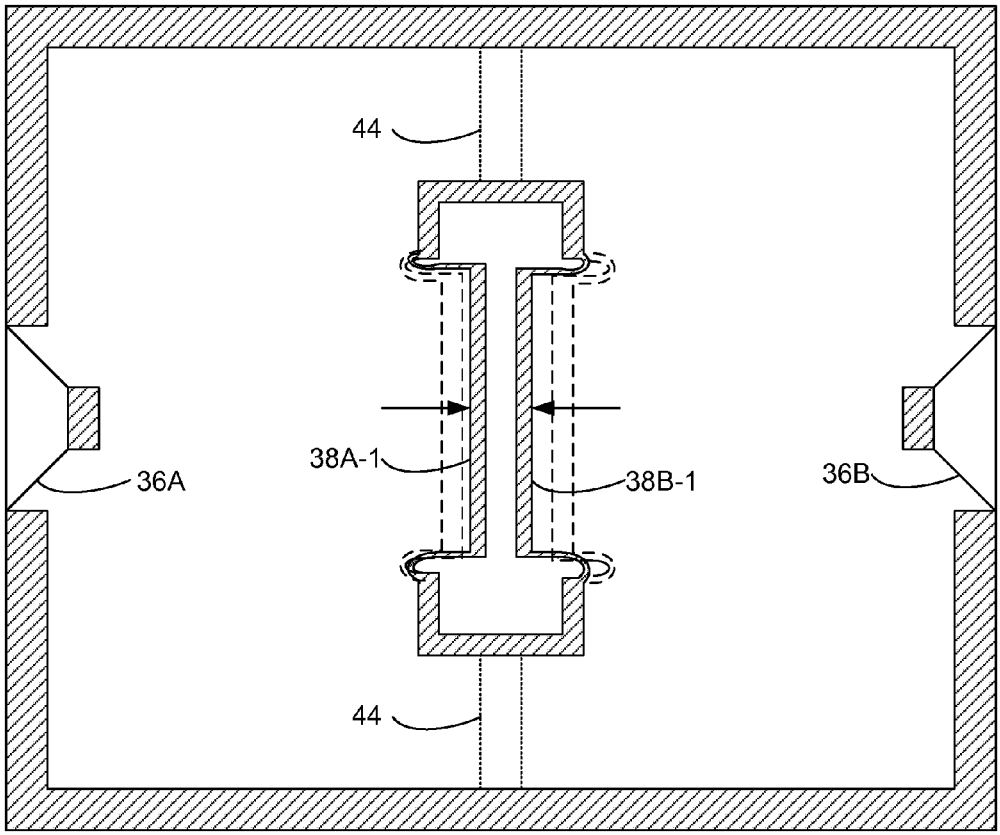
FIGS. 3A and 3B are cross-sectional views of an audio device, for illustrating some aspects of the invention.
Figure 3B:
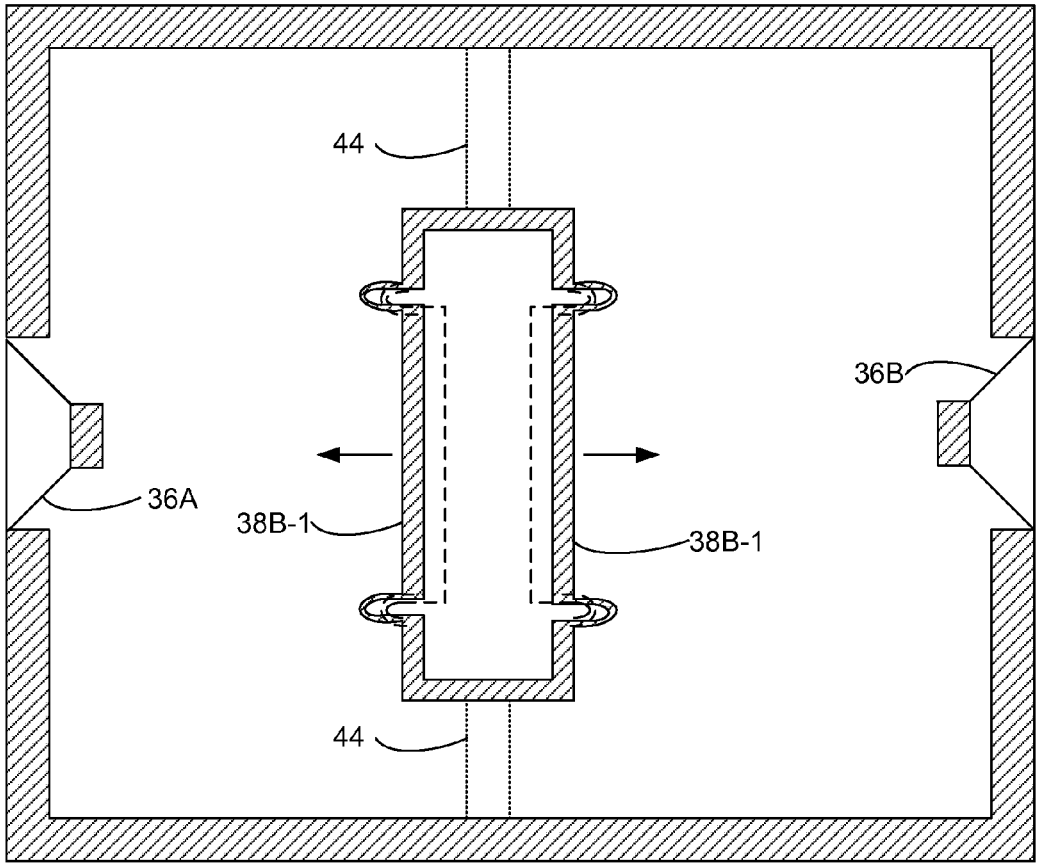

FIGS. 3A and 3B are cross-sectional views of an acoustic device similar to the acoustic device of FIGS. 2A-2B, for illustrating one aspect of the invention. In the acoustic devices of FIGS. 3A and 3B the baffle structure may not be present and is shown in dotted lines. The operation of the acoustic drivers 36A and 36B causes the air pressure adjacent the passive radiator surfaces 38A-1 and 38B-1 that face the interior of the enclosure (hereinafter "interior surfaces") to oscillate so that the air pressure is alternately greater than and less than the air pressure adjacent the passive radiator surfaces that face the exterior of the enclosure, including the surfaces that face the cavity, (hereinafter "exterior surfaces"). When the air pressures adjacent the interior surfaces are greater than the air pressures adjacent the exterior surfaces (which in this case face the cavity) the pressure differential causes motion of the passive radiator surfaces towards each other as shown in FIG. 3A. Conversely, when the air pressures adjacent the interior surfaces are less than the air pressures adjacent the exterior surfaces (which in this case face the cavity) the pressure differential causes motion of the passive radiator surfaces away from each other as shown in FIG. 3B.

The features of the invention embodied in the audio device of FIGS. 1A-3B provide several advantages over conventional passive radiator equipped audio devices.

Using passive radiators (sometimes referred to as "drones") is advantageous over using ports to augment the low frequency radiation because passive radiators are less prone to viscous losses and to port noise and to other losses associated with fluid flow, and because they can be designed to occupy less space, which is particularly important when passive radiators are used with small enclosures.

Tuning a single passive radiator to a desired frequency range may require that the mass of the passive radiator be substantial relative to the mass of the audio device. The mechanical motion of the passive radiator may result in inertial reactions that can cause the enclosure to vibrate or "walk." Vibration of the enclosure is annoying, and is particularly troublesome in devices that include components such as CD drives or hard disk storage devices that are sensitive to mechanical vibration. In normal operation, the passive radiators in a device according to the invention move in opposing directions in space, or, stated differently, are out of phase mechanically. The inertial forces tend to cancel, greatly reducing the vibration of the device.

Placing the passive radiators so that the exterior surfaces face into a cavity and so that they are transverse to the outside surfaces of the enclosure is advantageous to placing passive radiators that face the exposed exterior surfaces because the passive radiators require less protection from damage due to the passive radiator being bumped, kicked, poked, or the like.

Using two or more passive radiators is advantageous over using one passive radiator because the inertial forces associated with the passive radiators may be made to cancel, and individual passive radiators may be smaller. This is especially advantageous for small devices, because there may not be a single surface area large enough to mount a single passive radiator. Additionally, each of the two passive radiators can have less mass than a single passive radiator. This feature is especially advantageous in large devices, because a single passive radiator may weigh enough that the design of the passive radiator suspension becomes difficult.

Figure 4:
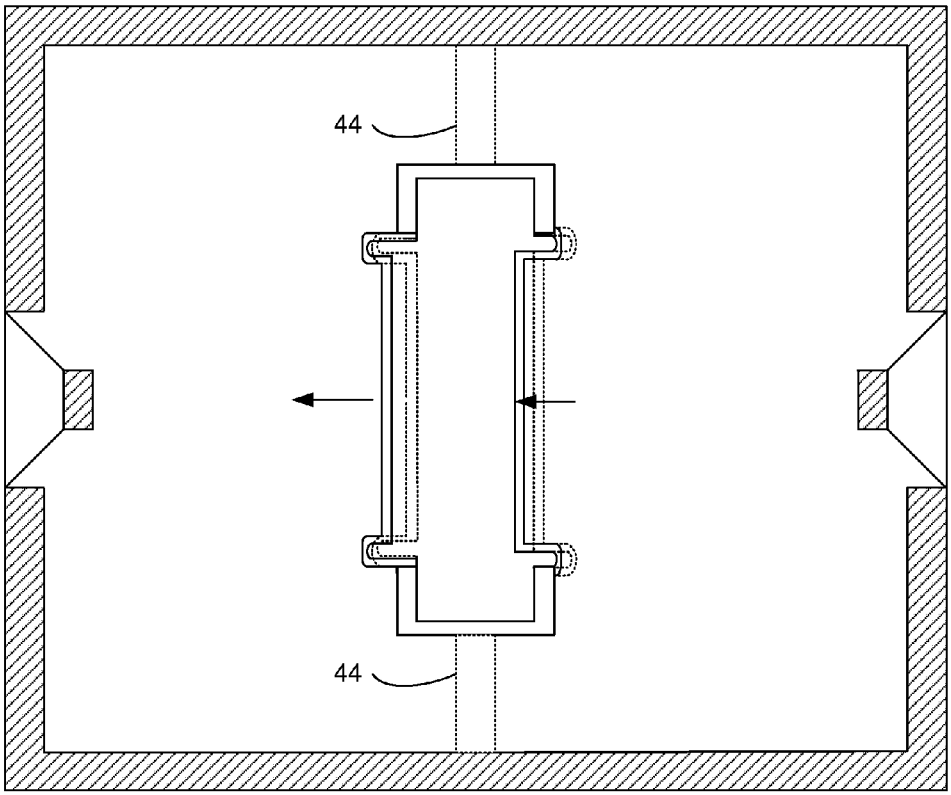
FIG. 4 is a cross sectional view of an audio device illustrating common mode vibration.

Referring to FIG. 4, there is shown a "common mode" vibration condition that may occur when passive acoustic elements such as passive radiators or ports are positioned so that they can acoustically couple and resonate from the acoustic coupling. Common mode vibration is more likely to occur if baffle 44, shown in dotted lines in this figure, is not present. If the passive radiators differ even slightly in mass, surface area, suspension characteristics, gasket leakage, placement or orientation relative to the driving electroacoustical transducer, or other characteristics, common mode vibration is more likely to occur, and is likely to be more severe. Common mode vibration is typically undesirable. The two passive radiators may oscillate in the same direction, so that the inertial reactions of the two passive radiators are additive rather than subtractive, causing vibration similar to the vibration that might be experienced with a single passive radiator. Additionally, the acoustic energy radiated by one passive radiator may partially or fully cancel the acoustic radiation radiated by the other passive radiator, which results in a significant reduction in output by the device at certain frequencies. Common mode vibration may result in significant losses of efficiency or negative effects on other performance characteristics of the acoustic device, such as the smoothness of the frequency response.

Referring again to FIG. 2B, the baffle structure acoustically isolates the two chambers. The first passive radiator 38A is acoustically coupled to first acoustic driver 36A and so that first passive radiator 38A is acoustically isolated from the air in chamber 42, from second passive radiator 38B and from second acoustic driver 36B. The second passive radiator 38B is acoustically coupled to second acoustic driver 36B and the second passive radiator 38B is acoustically isolated from the air in chamber 40, from first passive radiator 38A and from first acoustic driver 36A. The acoustic isolation reduces the likelihood of a common mode vibration condition.

Figure 5A:
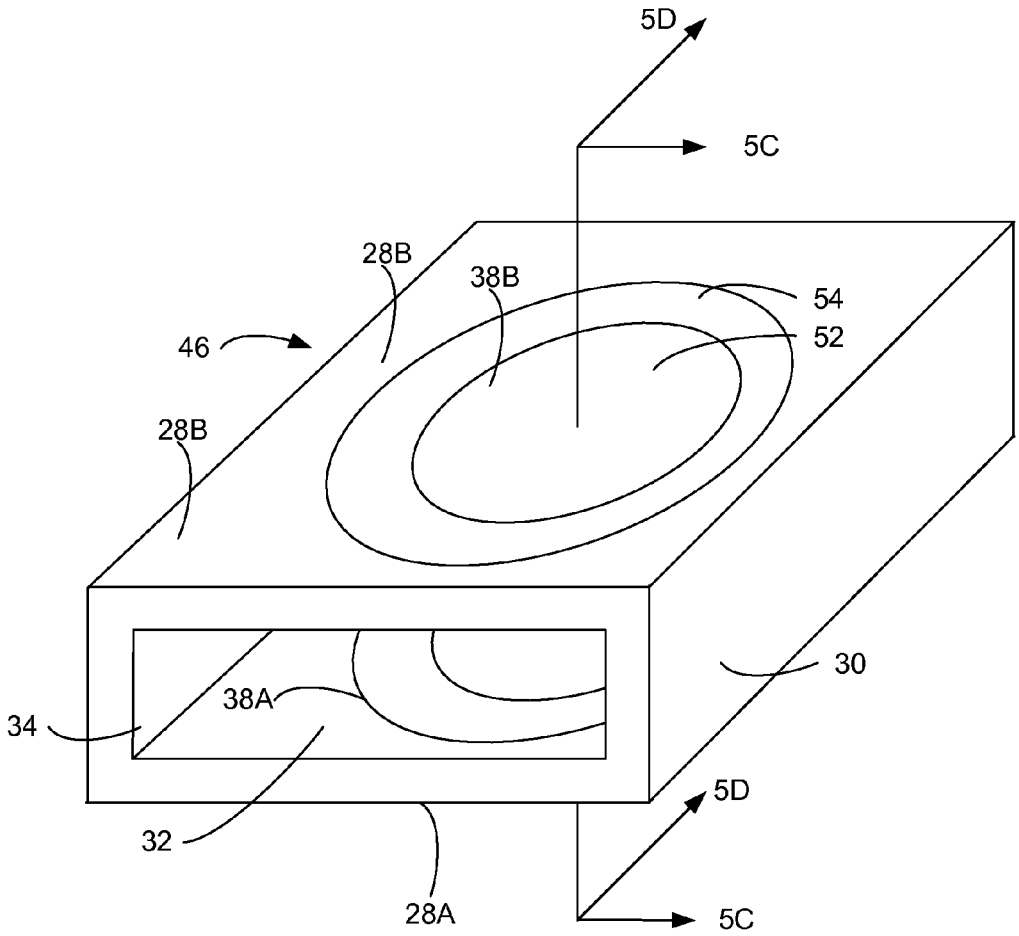
FIGS. 5A-5D are views of a module incorporating features of the invention.
Figure 5B:
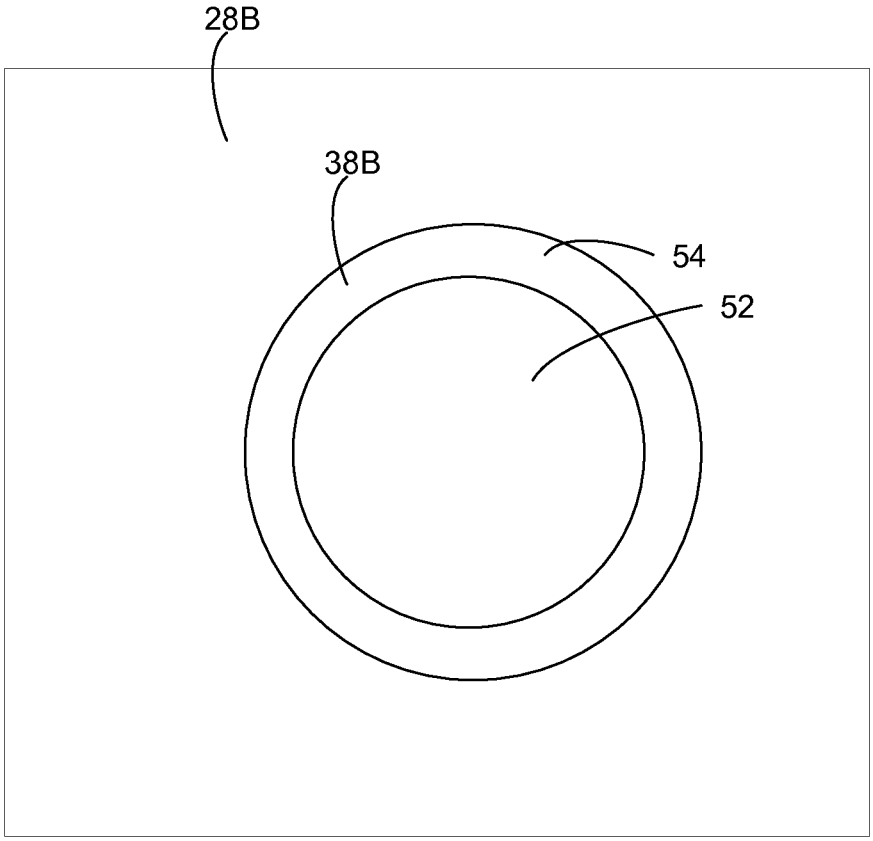
Figure 5C:
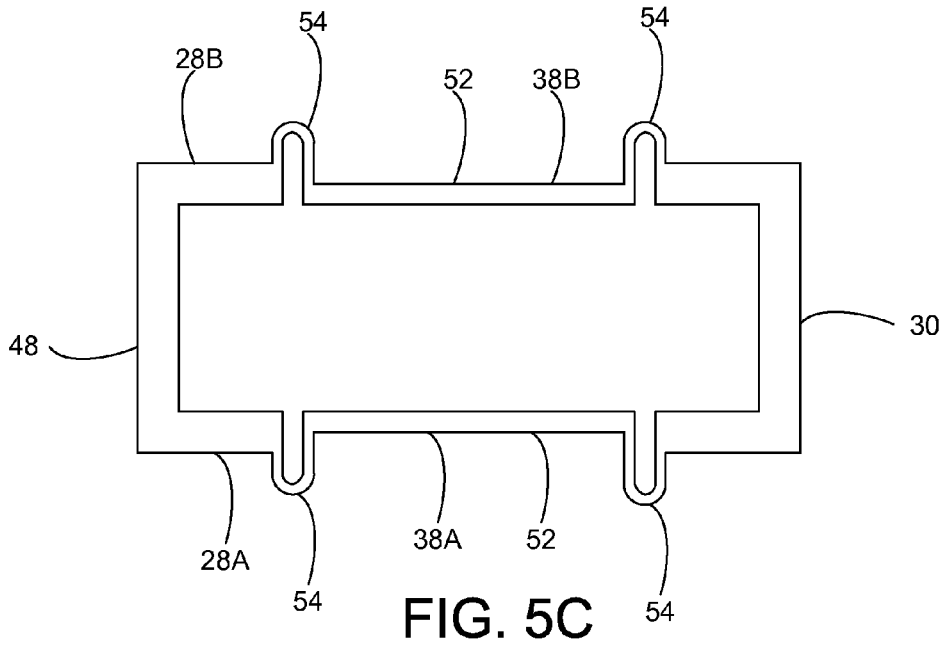
Figure 5D:
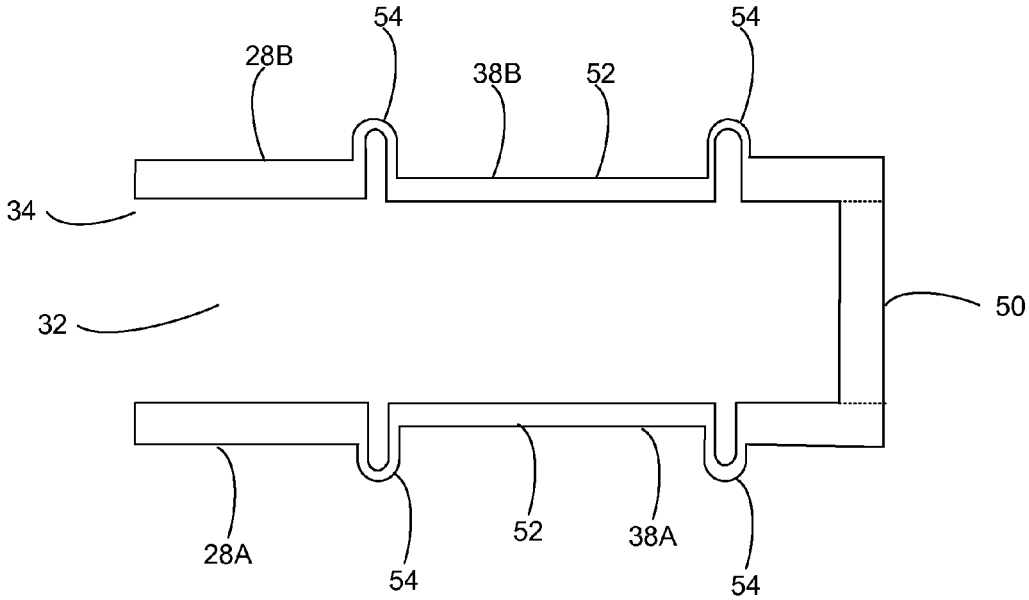

Referring to FIGS. 5A-5D, there are shown an isometric view, a top plan view, and cross-sectional views taken along the lines indicated in FIG. 5A of a module incorporating features of the invention. Components that implement elements of previous figures have like numbers as the corresponding elements. Module 46 may be in the form of a three dimensional structure with at least one opening, bounded by walls 28A, 28B, 30, and 48 and back 50 of FIG. 5D. Module 46 has mounted in wall 28A a first passive radiator 38A and has mounted in wall 28B a second passive radiator 38B, opposite to and coaxial with, passive radiator 38A. Module 46 is mountable in an aperture of an acoustic enclosure to form cavity 32 of previous figures and so that opening 34 faces the external environment. The walls may be dimensioned and configured so that the cavity has the acoustic effect desired; for example, so that the cavity has a minimal acoustic effect on the acoustic energy radiated into the cavity by the passive radiators. Additionally, depending on the geometry of the acoustic enclosure and the placement of the module, one or more of walls 30, 48, or 50 may be eliminated (for example as indicated by the dashed lines in wall 50 of FIG. 5D) so a second opening in the module mounts in a second aperture in the acoustic enclosure to form a second cavity opening.

Walls 28A, 28B, 30, 48, and 50 may be formed of a material suitable for loudspeaker enclosures, such as particle board, wood, wood laminate, or a rigid plastic. Using a plastic material facilitates molding the wall structure as a single unit. Passive radiators 38A and 38B may be conventional, with a vibratile radiating surface 52 and a suspension system including a surround 54. The passive radiators can be dimensioned and configured consistent with the intended use.

The modular design of the module 46 provides a designer with great flexibility in arranging the elements of an audio device incorporating the invention. FIGS. 6A-6I show some diagrammatic examples of audio devices using module 46.

Figure 6A:
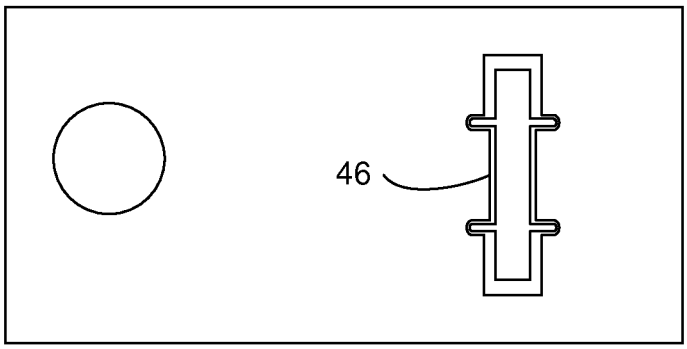
FIGS. 6A-6I are audio devices incorporating the module of FIGS. 5A-5D.
Figure 6B:
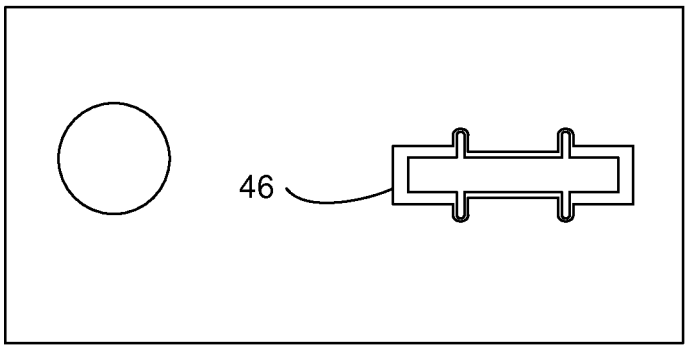
Figure 6C:
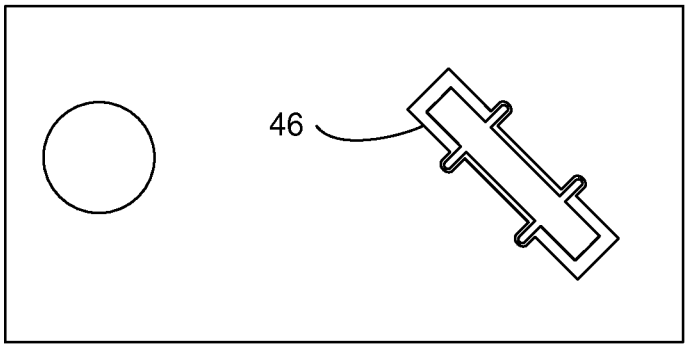
Figure 6D:
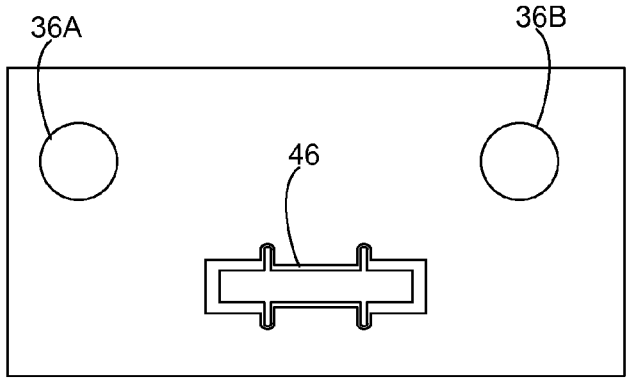
Figure 6E:
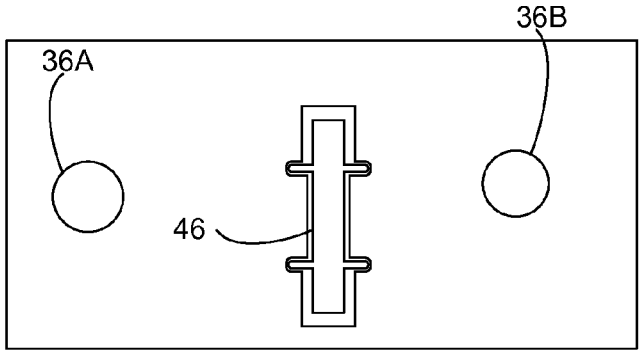

FIGS. 6A-6C show that a module having an elongated opening can be oriented so that the direction of elongation is vertical, horizontal, or slanted. Additionally, the position of the module can be moved about to accommodate additional acoustic drivers, as in the examples of FIGS. 6D, 6E, and 6F. The different orientations can be provided by modifying the position and orientation of the aperture in the acoustic enclosure; the modifying does not require extensive remolding of the entire acoustic enclosure.

Figure 6F:
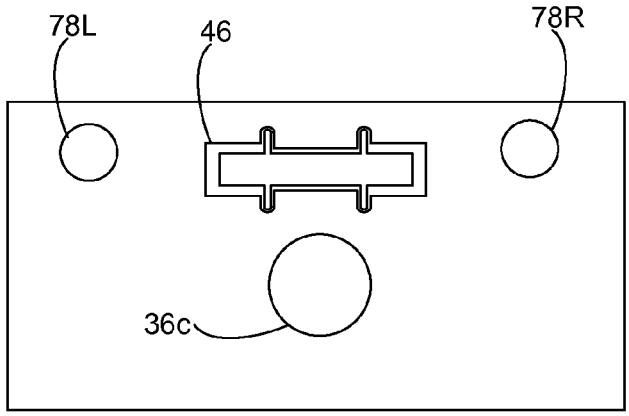
Figure 6G:
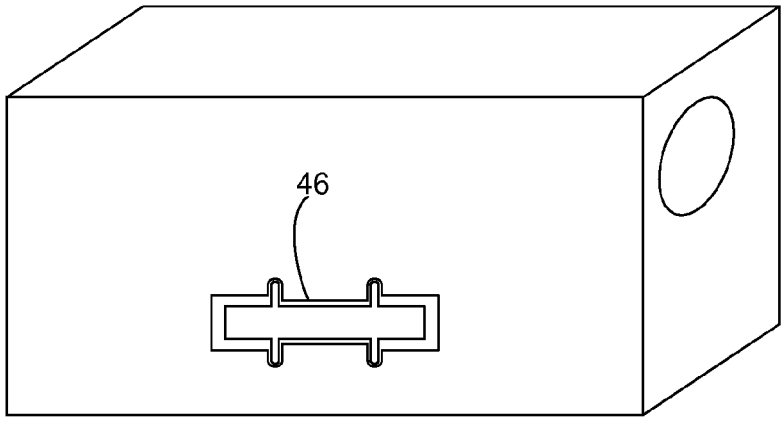
Figure 6H:
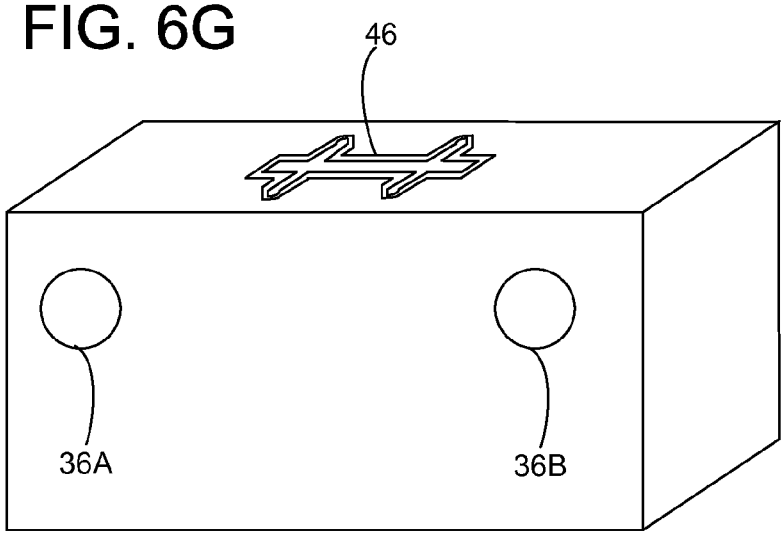
Figure 6I:
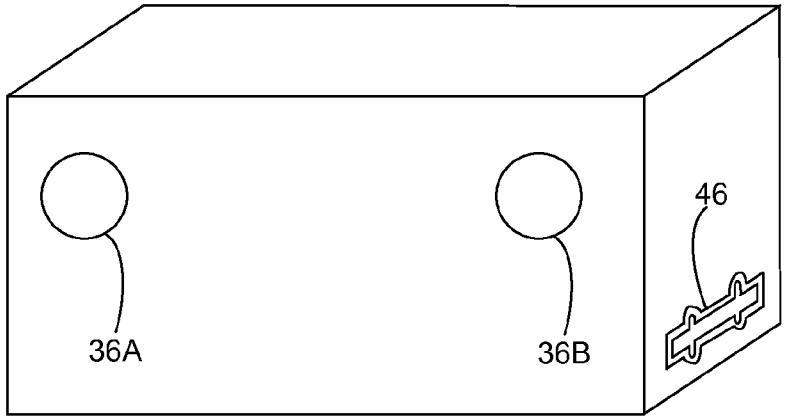

In addition to the arrangements of FIGS. 6A-6F, the aperture in the acoustic enclosure in which the module 46 is mounted can be in a different surface of the enclosure than the acoustic driver, as in FIG. 6G. The aperture may also be mounted in the top (as shown in FIG. 6H), a side (as shown in FIG. 6I), or back of the enclosure, or in the bottom of the enclosure if the enclosure has standoffs to space the bottom of the enclosure from the surface on which it is placed.

If the passive radiator module is implemented in a device that has more than one bass electroacoustical transducer, the passive radiator module is most effective if the bass acoustic drivers receive audio signals that are substantially identical in the frequency band in which the passive radiator has a maximum excursion. So, for example, in the implementations of FIGS. 6D and 6E, if the two acoustic drivers 36A and 36B are full range drivers, it is desirable that signals communicated to the two drivers are substantially identical and in phase in the frequency band of maximum passive radiator excursion. In the implementation of FIG. 6F, if the acoustic drivers 78L and 78R are tweeters, "twiddlers," or mid-range transducers, and acoustic driver 36C is a woofer, the passive radiator module 46 can be acoustically isolated from the transducers 78L and 78R if desired by, for example, sealing the backs of transducers 78L and 78R. Passive radiators are typically for augmenting bass acoustic energy. Providing audio signals that are substantially identical and in phase in the bass spectral band results in motion of the two passive radiators that is substantially identical and mechanically out of phase, which results the greatest cancellation of passive radiator induced inertial reactions, and thus the audio device enclosure vibrates very little. If the signals are not identical an audio device according to the invention will in most situations vibrate less than a device not incorporating the invention. Signal processing systems for providing substantially identical signals in the bass frequency band are shown below.

Figure 7A:
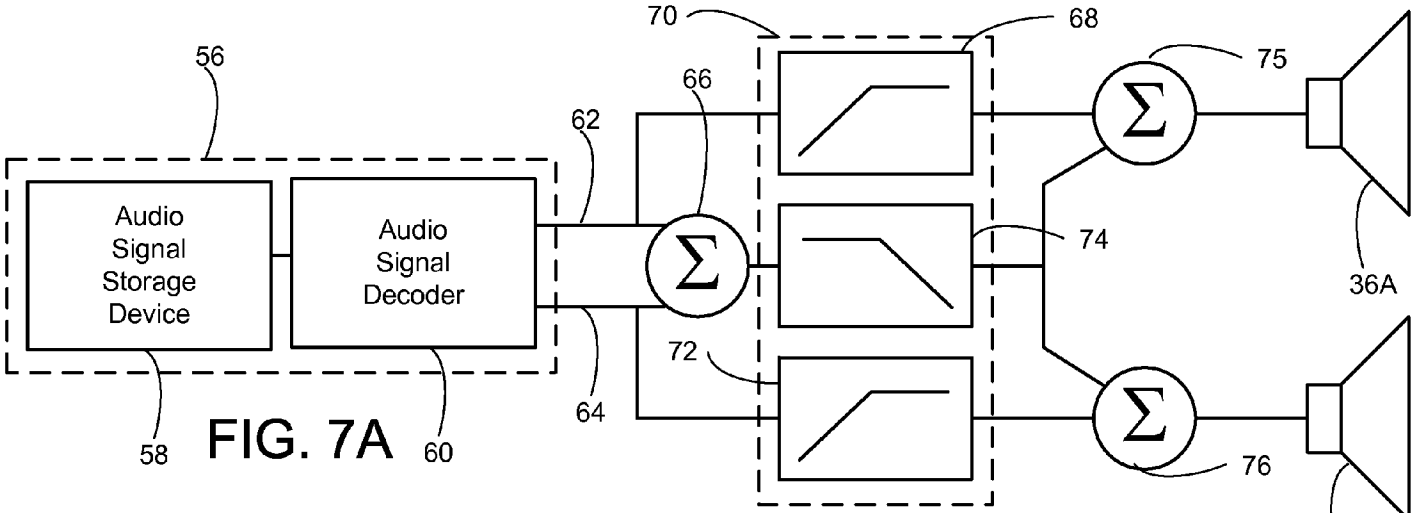
FIGS. 7A and 7B are block diagrams of audio signal processing circuits for providing audio signals for devices incorporating the invention.
Figure 7B:
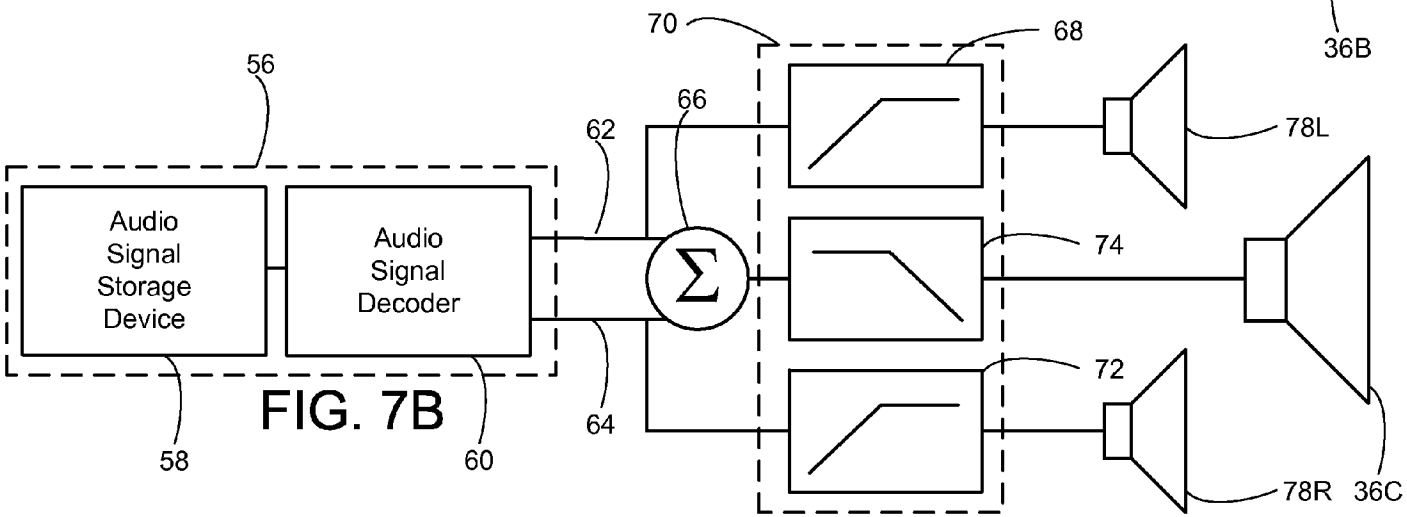

Referring now to FIGS. 7A and 7B, there are shown two audio processing circuits for providing audio signals that are substantially monaural in the bass spectral frequency region. An audio signal source 56 may include an audio signal storage device 58 and an audio signal decoder 60. The audio signal source may output a left channel signal on signal line 62 and a right channel signal on signal line 64. Signal line 62 couples audio signal source 56 to a summer 66 and to a high pass filter 68 in a crossover network 70. Signal line 64 couples audio signal source 56 to summer 66 and to high pass filter 72 in crossover network 70. Output of summer 66 is coupled to low pass filter 74. In FIG. 7A, the output of high pass filter 68 is coupled to summer 75, which is coupled to full range acoustic driver 36A and the output of high pass filter 72 is coupled to summer 76, which is coupled to full range driver 36B. The output terminal of low pass filter 74 is coupled to summers 75 and 76. In FIG. 7B, the output terminal of high pass filter 68 is coupled to non-bass transducer 78L, the output terminal of high pass filter 72 is coupled to non-bass transducer 78R, and low pass filter 74 is coupled to low frequency acoustic driver 36C. The circuits of FIGS. 7A and 7B may also contain components such as amplifiers, compressors, limiters, clippers, DACs, and equalizers that are not germane to the invention and are not shown in these views. The circuit of FIG. 7A is suitable for the audio devices of FIGS. 6D, 6E, 6G, 6H, and 6I, and the circuit of FIG. 7B is suitable for the audio device of FIG. 6F. Either of the circuits of FIGS. 7A and 7B may be adapted to audio signal sources having more than two input channels. Many other circuit topologies for providing monaural bass signals are available.

The audio signal storage device 58 may be a digital storage device such as RAM, a CD drive or a hard disk drive. The audio signal decoder 60 may include digital signal processors and may also include DACs and analog signal processing circuits. The audio signal source 56 may be a device such as a portable CD player or portable MP3 player. The audio signal storage device 58 or the audio signal source 56, or both, may be mechanically detachable from other circuit elements. The audio signal source 56 and the audio signal storage device 58 may be separate devices or integrated into a single device, which may be mechanically detachable from other circuit elements. Other circuit elements may be conventional analog or digital components. As stated previously, devices according to the invention are particularly advantageous with devices that incorporate hard disk drives or CD drives or other devices that are particularly sensitive to mechanical vibration. An audio device is also advantageous for use with small devices such as MP3 players, because the sound reproduction system can be made small and easily portable, but still capable radiating more low frequency acoustic energy than typical portable reproduction devices of the same size and weight. Non-bass transducers 78L and 78R may be "twiddlers," that is, transducers that radiate both midrange and high frequencies, or mid-range transducers, or tweeters. There may also be additional transducers mounted in the enclosure or in separate enclosures. In the discussion of FIGS. 7A and 7B and in discussions of previous figures, "coupled" with respect to the transmission of audio signals means "communicatingly coupled," recognizing that audio signals can be transmitted wirelessly, without a physical coupling.

Figure 8A:
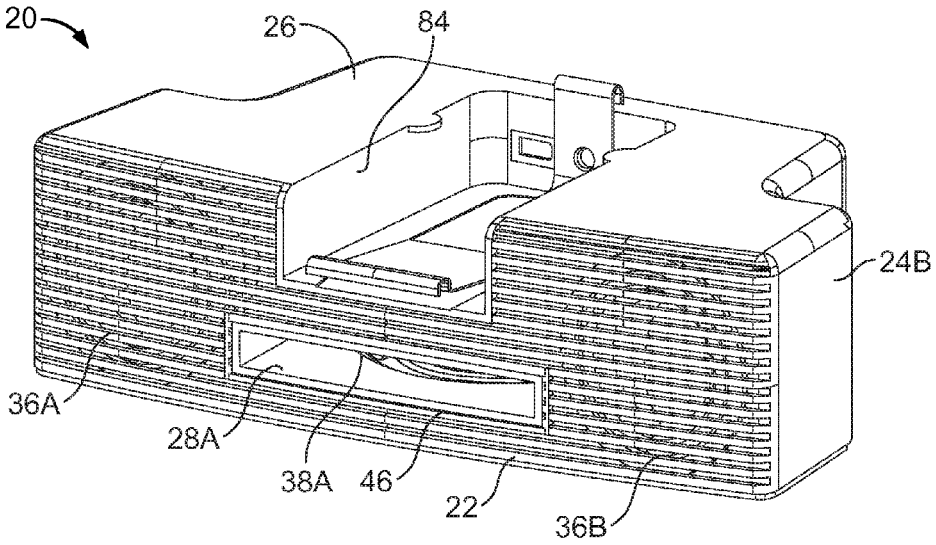
FIGS. 8A-8D are isometric views of a device incorporating the invention.
Figure 8B:
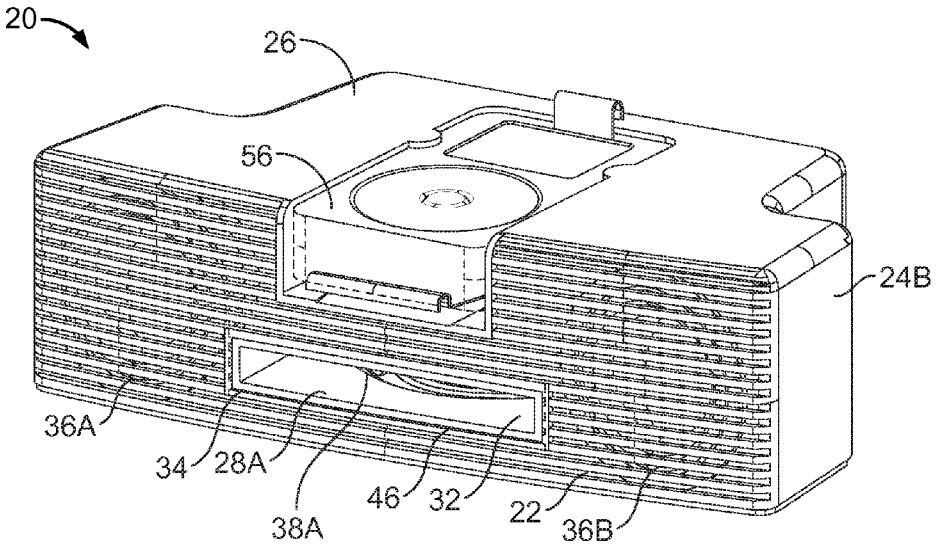
Figure 8C:
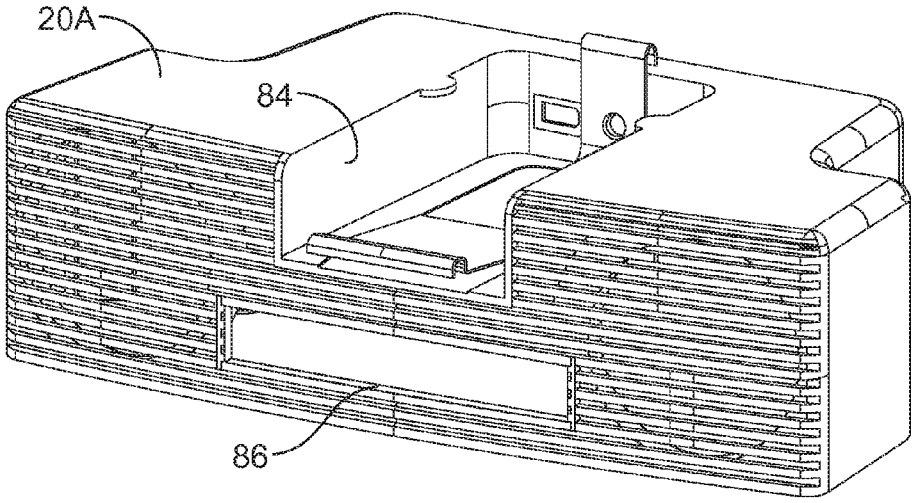
Figure 8C:
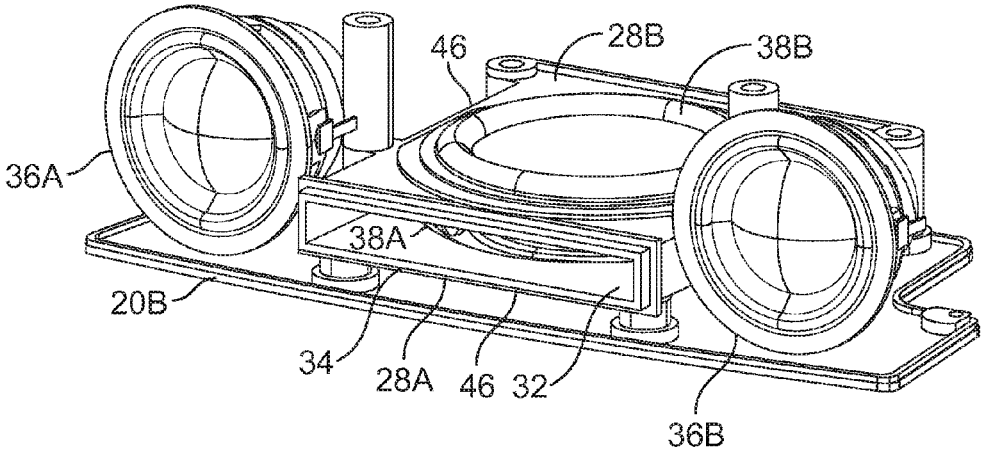
Figure 8D:
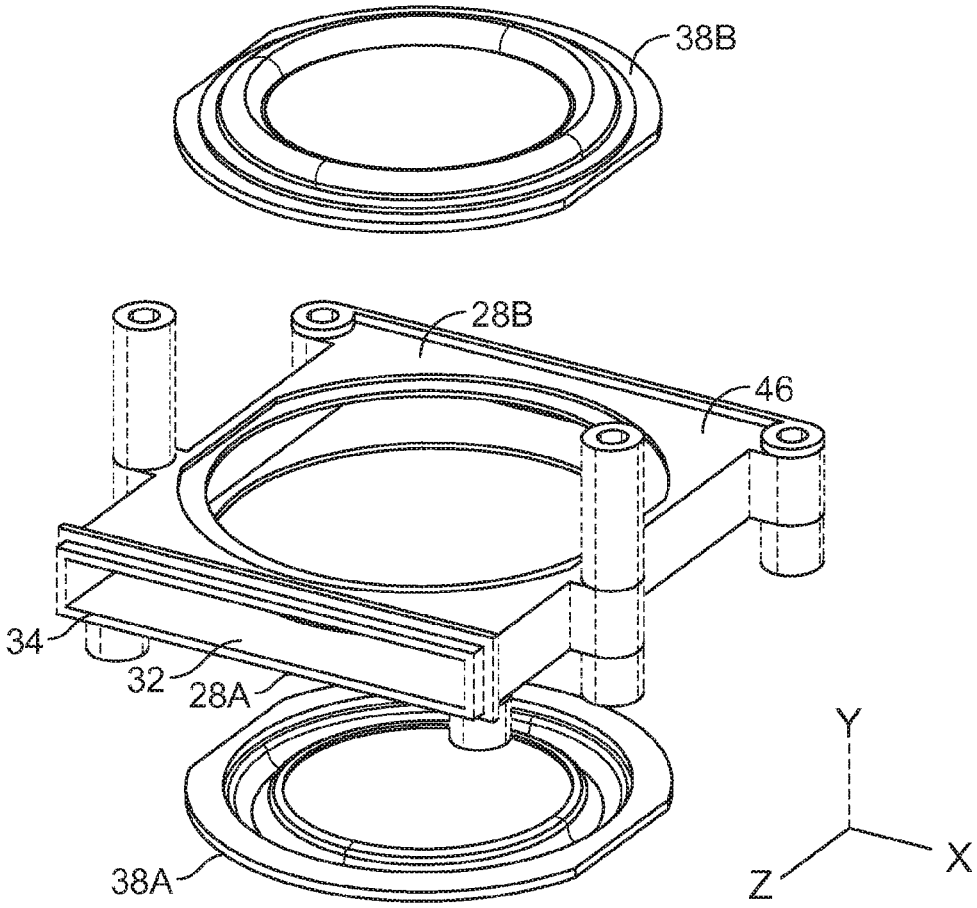

FIGS. 8A-8D, show isometric views of a device implementing the principles of the invention. In FIGS. 8A-8D, reference numerals refer to elements implementing like-numbered elements of previous figures. The device of FIGS. 8A and 8B is in the form of FIG. 6D, using the signal processing circuit of FIG. 7A. The implementation of FIG. 8A includes a docking station 84, into which an audio storage device 58, an audio signal decoder 60, or an audio signal source 56 can be placed. The implementation of FIG. 8B shows the device of FIG. 8A, with an audio signal source, in this case a portable MP3 player, in place in the docking station 84. FIG. 8C shows a blow-up view of the device of FIG. 8A. The acoustic enclosure 20 is formed of two mating sections, 20A and 20B. Module 46 is configured so that cavity opening 34 mates with enclosure aperture 86. FIG. 8D shows a blow-up of the module 46. The implementation of FIG. 8D includes elements such as standoffs, bosses, and the like to assist with the assembly of the device.

Figure 9A:
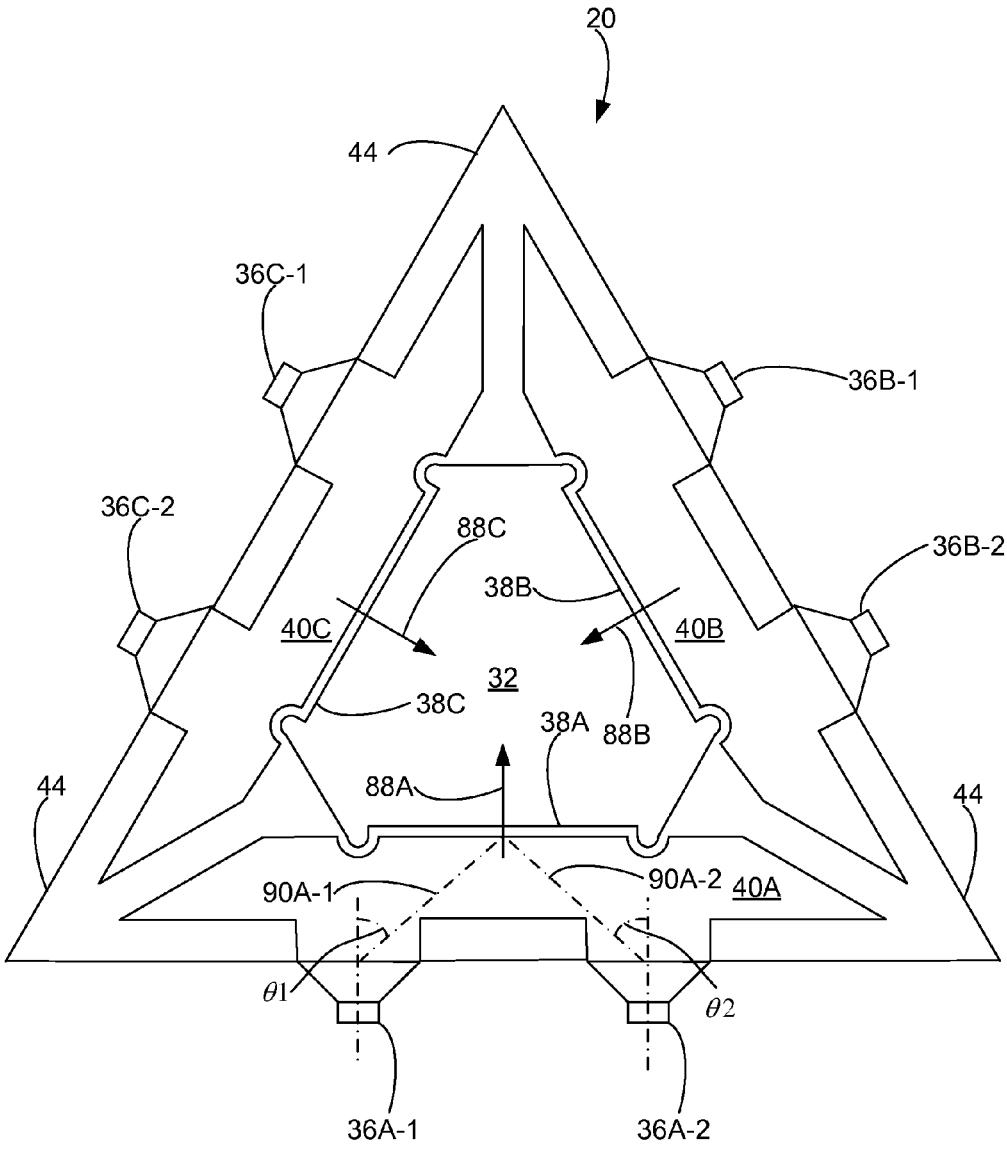
FIGS. 9A-9C are cross sectional views of more embodiment of the invention.
Figure 9B:
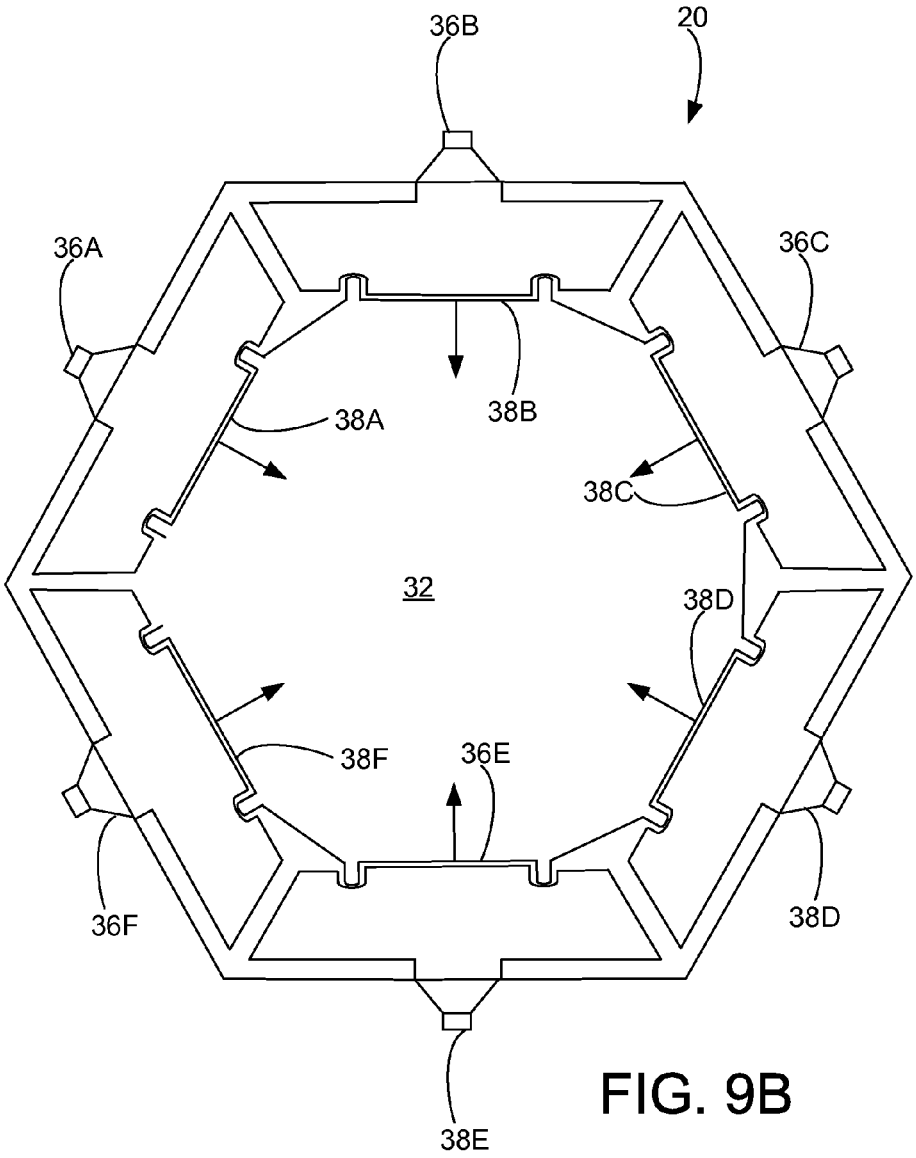
Figure 9C:
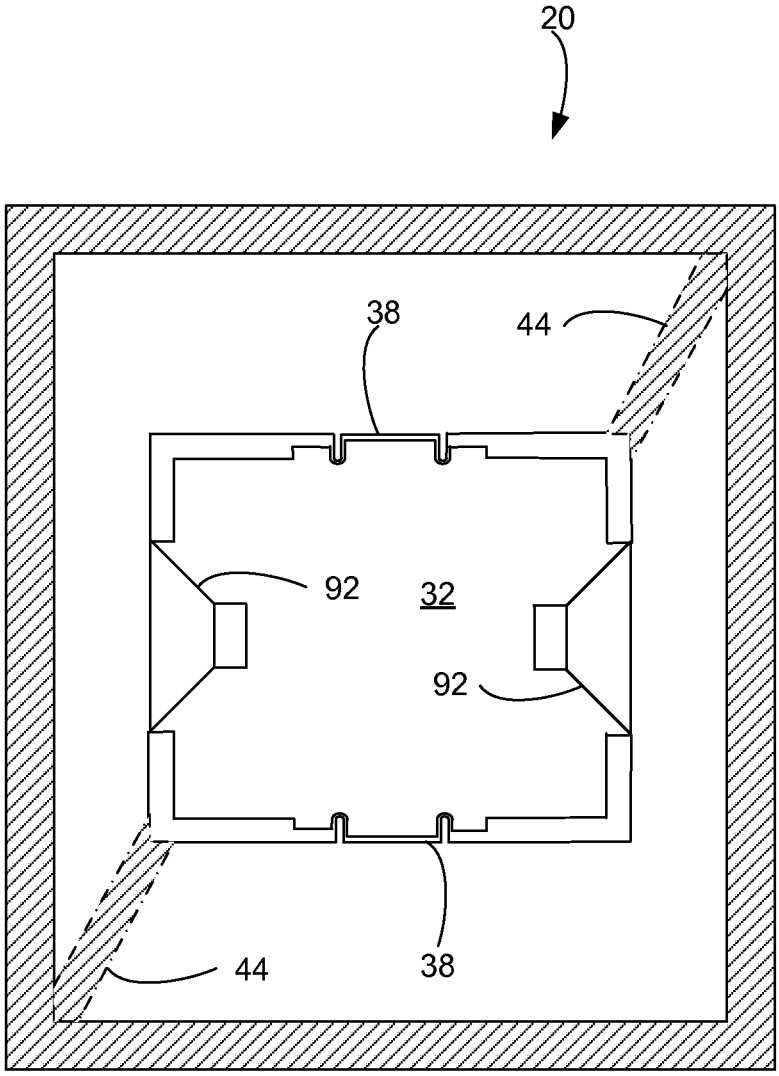

FIGS. 9A-9C show diagrammatic cross-sections of alternate embodiments of the invention, describing additional aspects of the invention. Reference numbers in FIGS. 9A-9C refer to elements that perform substantially the same function in the same manner as like numbered elements in the other figures. In FIG. 9A, acoustic enclosure 20 includes a baffle structure 44 that acoustically isolates a first chamber 40A, and second chamber 40B, and a third chamber 40C from each other. Acoustic drivers 36A-1 and 36A-2 are positioned in a wall of chamber 40A so that they radiate acoustic energy into chamber 40A. Similarly, acoustic drivers 36B-1 and 36B-2 are positioned in a wall of chamber 40B so that they radiate acoustic energy into chamber 40B, and acoustic drivers 36C-1 and 36C-2 are positioned in a wall of chamber 40C so that they radiate acoustic energy into chamber 40C. Passive radiator 38A is positioned so that one surface faces chamber 40A and one surface faces cavity 32. Similarly, passive radiator 38B is positioned so that one surface faces chamber 40B and one surface faces cavity 32, and passive radiator 38C is positioned so that one surface faces chamber 40C and one surface faces cavity 32. Similar to the device of FIGS. 2A and 2B, cavity 32 may be constructed and arranged so that it has a minimal acoustic effect on the acoustic energy radiated into it.

The device of FIG. 9A operates in a manner similar to the device of FIGS. 2A and 2B.

Acoustic drivers 36A-1, 36A-2, 36B-1, 36B-2, 36C-1, and 36C-2 radiate acoustic energy to the environment external to the enclosure 20. Additionally, acoustic drivers 36A-1, 36A-2, 36B-1, 36B-2, 36C-1, and 36C-2 each radiate acoustic energy into one of chambers 40A, 40B, and 40C. The acoustic energy radiated into the chambers interacts with the air in the chambers to cause passive radiators 38A, 38B, and 38C to vibrate, thereby radiating acoustic energy into cavity 32. The acoustic energy radiated into cavity 32 is then radiated to the external environment to supplement the acoustic energy radiated directly to the environment by the acoustic drivers.

The interaction of the acoustic energy radiated into each of the chambers and the air in the chamber results in a force being applied to the passive radiator surfaces, represented by vectors 88A-88C, in which the magnitude of the vectors represents the product of the mass and the magnitude of the acceleration and the direction of the vectors represents the direction of the acceleration. The characteristics, positioning, and geometry of the components of the device of FIG. 9A are selected so that the resultant force vectors representing the motion of the three passive radiators sum to a vector of lesser magnitude than any one of the individual force vectors, and preferably sum to zero. One combination of characteristics, positioning, and geometry that achieves a zero vector sum is: symmetrically placed substantially identical acoustic drivers; three chambers that have the same volume and are substantially identical or minor image; substantially identical passive radiators; a cavity having the form of a right prism with a cross-section in the form of an equilateral triangle; placing the passive radiators so that the axes are coplanar and each at the midpoint of one of the sides of the equilateral triangle; and providing each of the acoustic drivers with substantially the same audio signal. It can be noted that the configuration of FIG. 9A achieves a result similar to the configuration of FIG. 2A without the directions of motion of the passive radiator surfaces being parallel or coincident. To provide improved vibration performance, it is not necessary for the force vectors to sum to exactly zero, so long as the magnitude of the summed force vectors is less than the magnitude of the force vector of a single passive radiator. The embodiment of FIG. 9A also shows another feature of the invention. Each of the pairs of acoustic drivers are positioned symmetrically relative to the corresponding passive radiator so that pressure differences across the passive radiator surface are low, preferably close to zero. One configuration that results in symmetric positioning of the pair of acoustic drivers is to position the two acoustic drivers so that their axes are coplanar with the axis of the passive radiator, so that the distance 90A-1 between a point, for example the center, of an acoustic driver cone to the center of mass of the passive radiator surface and the distance 90A-2 between the corresponding point on the other acoustic driver and the center of mass the passive radiator surface are equal, and so the angle 01 between the axis of motion of acoustic driver 36A-1 and a line connecting a point, such as the center, of an acoustic driver to the center of the passive radiator is equal to the angle 02 between the axis of motion of acoustic driver 36A-2 and a line connecting the corresponding point and the center of the passive radiator. Another configuration in which acoustic drivers are positioned symmetrically is to place the acoustic drivers in an equilateral triangle in a plane parallel to the plane of the passive radiator and so that a line in the intended direction of motion of the passive radiator passing through the center of the equilateral triangle passes through the center of mass of the passive radiator. Low pressure differences across the passive radiator surface reduces the likelihood of "rocking" motion, in which diametrically opposed points of the passive radiator surface move in different directions, resulting in "sloshing" and in the loss of acoustic output and efficiency.

FIG. 9B shows another alternative embodiment of the invention. In the embodiment, the enclosure and the cavity have the form of a right prism having a regular hexagonal cross section, with each of the passive radiators having coplanar axes of motion, each positioned at a midpoint of one of the sides of the hexagon. In the embodiment of FIG. 9B, each of the passive radiators is driven by a single acoustic driver. The acoustic drivers are positioned so that the acoustic drivers are coaxial with the corresponding passive radiators. A coaxial positioning of the passive radiator and the corresponding acoustic driver typically results in a low pressure difference across the passive radiator surface. Similar to the embodiment of FIG. 9A, the acoustic drivers 36A-36F may be substantially identical and receive a substantially identical audio signal; and the passive radiators 38A-38F may be substantially identical and may be positioned so that the forces applied to the passive radiator surfaces are represented by resultant vectors 88A-88F that sum to a vector of lesser magnitude than any one of the individual force vectors, and preferably sum to zero. The embodiment of FIG. 9B shows that with a larger number of passive radiators, the desired effect can be achieved with a configuration in which each of the passive radiators may have an intended direction of motion that does not have a significant parallel component with some of the other passive radiators.

The embodiments of FIGS. 9A and 9B illustrate another feature of the invention. The acoustic drivers are positioned so that the motor structures 92 of the acoustic drivers are outside the enclosure 20. This positioning is advantageous thermally, because heat generated by the action of the motor structures can be radiated directly to the external environment rather than into closed enclosure.

In the embodiment of FIG. 9C, an audio device in the form of the embodiment of FIG. 1 has acoustic drivers positioned so that the motor structures 92 of the acoustic drivers are in the cavity 32. Acoustic energy is radiated by the acoustic drivers directly into the cavity and, since the cavity has a minimal acoustic effect on the acoustic energy radiated into it, to the surrounding environment. Acoustic energy is also radiated by the acoustic drivers into the enclosure interior, where it interacts with the air in the enclosure to cause passive radiators 38 to radiate acoustic energy into the cavity and then to the surrounding environment. The air in the cavity is thermally coupled to the external environment, which is advantageous thermally. The configuration of FIG. 9C is thermally advantageous over configurations in which the motor structures are inside the acoustic enclosure, for the reason stated in the discussion of FIGS. 9A and 9B. The configuration of FIG. 9C is advantageous over configurations in which the motor structures are exposed, because the motor structure requires less protective structure to prevent damage from kicking, poking, etc. and to prevent users from touching hot and electrically conductive elements.

Many other extensions and variations of the elements of FIGS. 2A, 9A, 9B, and 9C are possible. For example the enclosure, the cavity, or both can have the form of a cylinder, with passive radiators positioned regularly about the circumference. The cavity, the enclosure, or both can be in the form of a polyhedron or continuous figure, with sufficient regularity and symmetry that the acoustic drivers and the passive radiators can positioned so that the force vectors describing the motion of the passive radiators sum to a zero or no zero vector. The cavity or enclosure or both can be in the form of a continuous figure or a sphere or spherical section. The cavity or enclosure or both may be an irregular figure, so long as passive radiators can be mounted in a manner such that the force vectors that characterize the motion of the passive radiators sums to a vector of lesser magnitude than any one of the individual force vector, and preferably sum to zero, and preferably so that the pressure difference across the passive radiator surface is small. A prismatically or cylindrically shaped enclosure may be configured so that one or more of the acoustic drives or one or more of the passive radiators, or both, are positioned in an end of the prism or cylinder.

Figure 10:
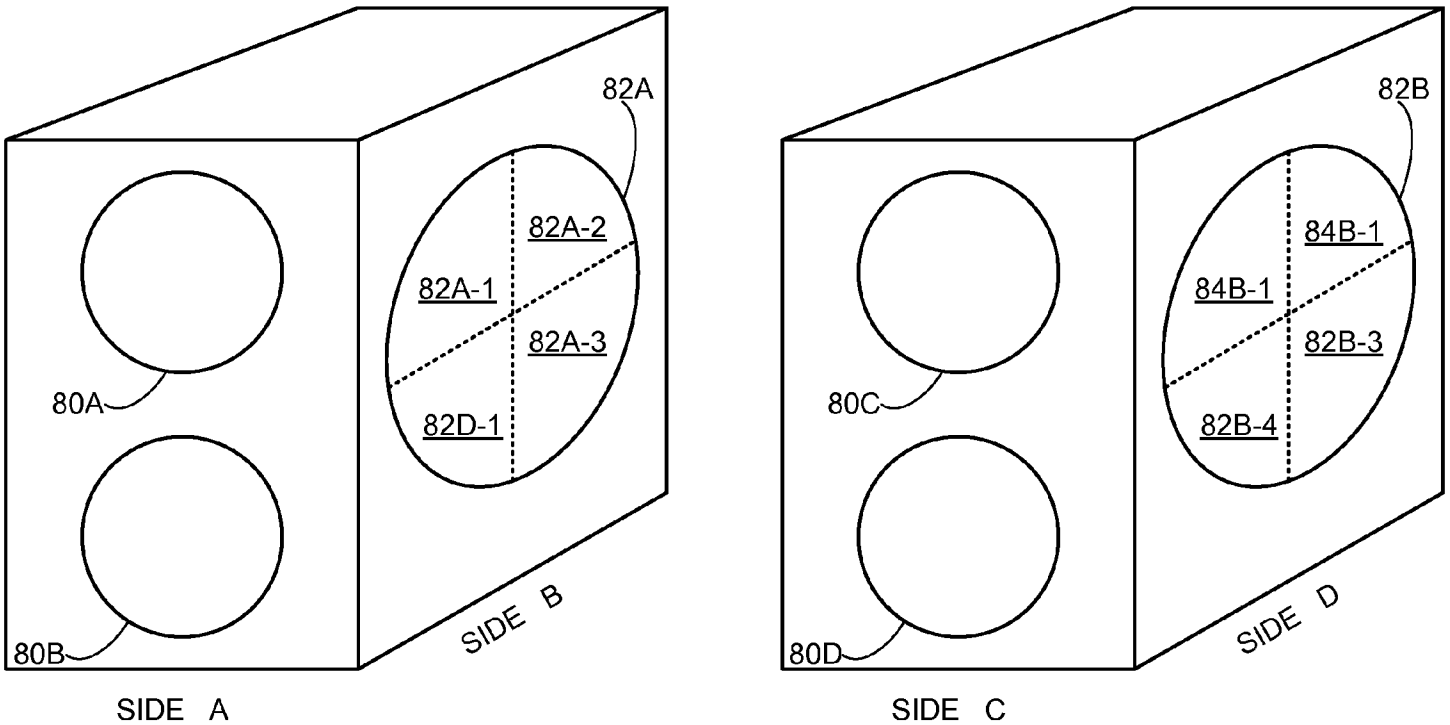
FIG. 10 includes 2 isometric views of another audio device incorporating the invention.
Figure 11A:
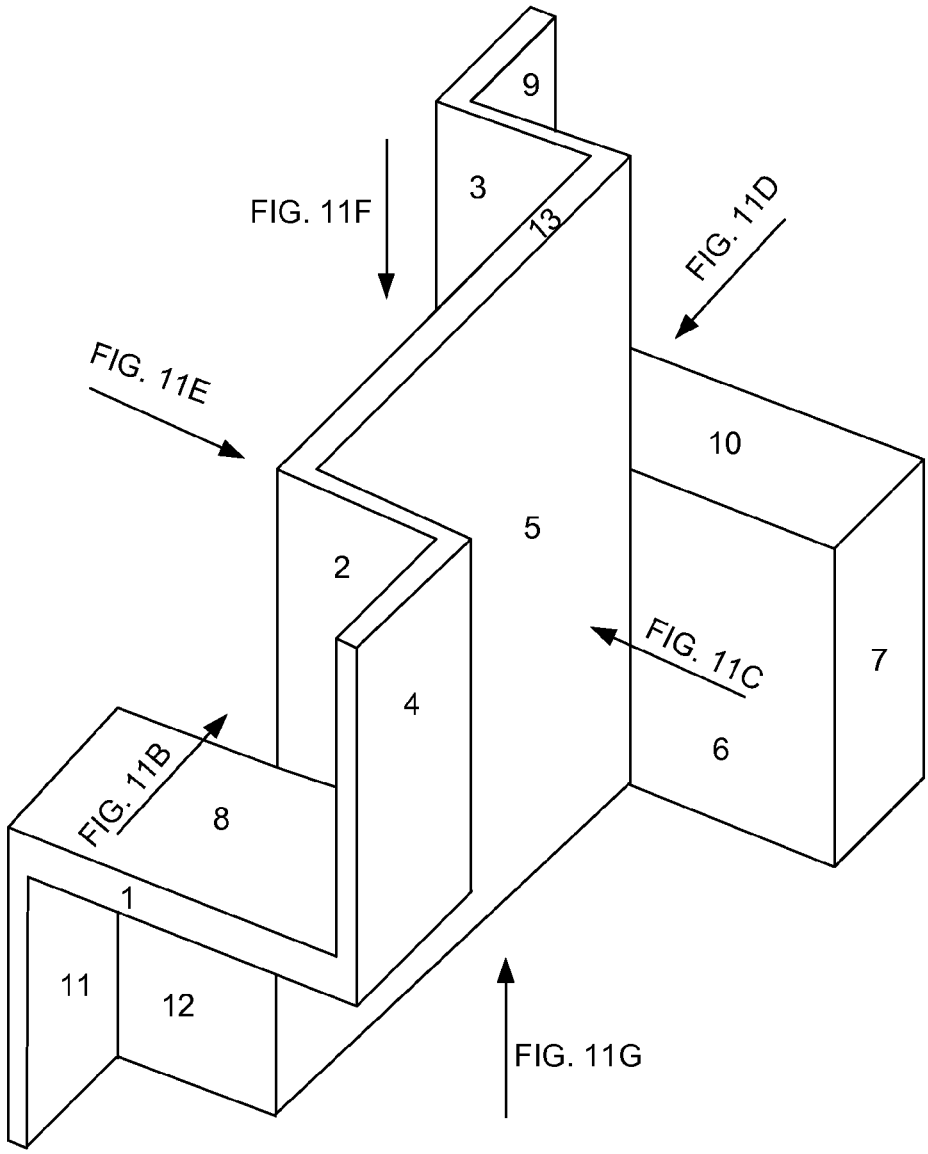
FIGS. 11A-11G are views of a baffle structure for use with the device of FIG. 10.
Figure 11C:
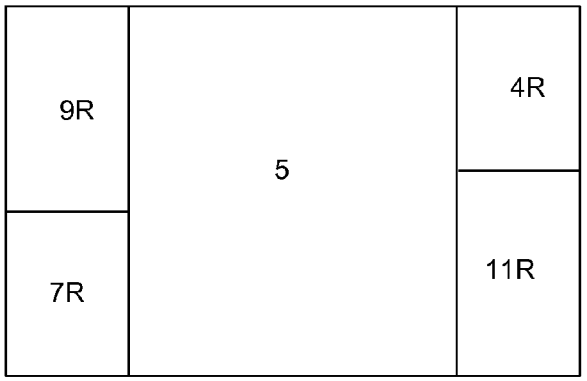
Figure 11E:
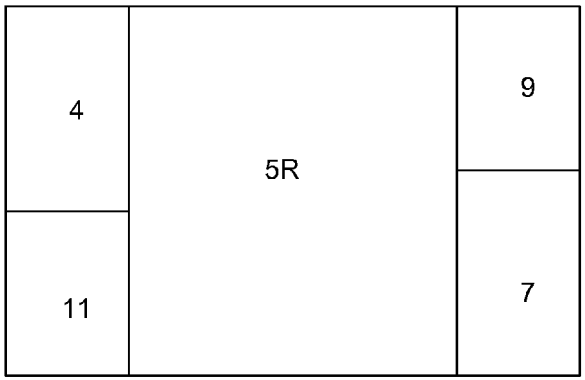
Figure 11B:
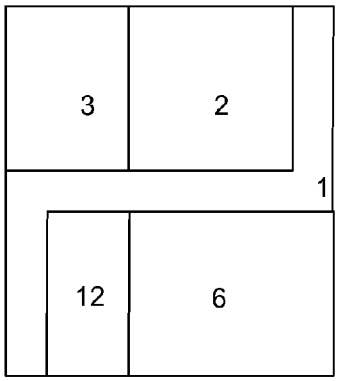
Figure 11D:
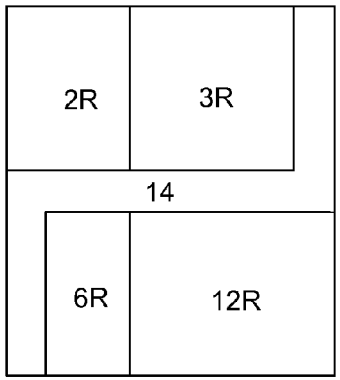
Figure 11G:
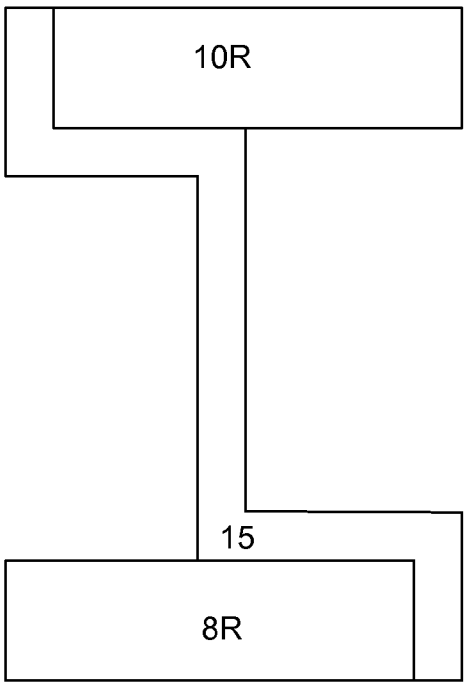
Figure 11F:
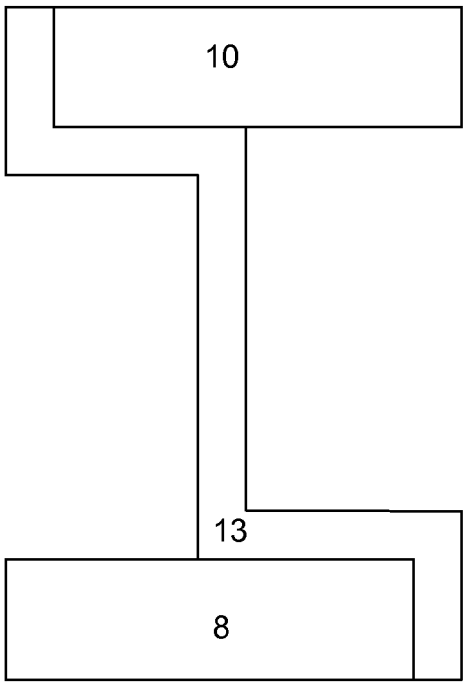

Referring to FIGS. 10A and 10B there are shown two isometric views of another audio device incorporating the invention. The audio device of FIGS. 10A and 10B may be a woofer or subwoofer unit of an audio system or home theater audio system that includes, in addition to the woofer or subwoofer unit, limited range satellite speakers (not shown). The device of FIG. 10 may be a substantially box-shaped structure having four sides, designated side A, side B, side C, and side D, and having a top and a bottom. Positioned in each of opposing sides A and C may be one or more (in this case two) acoustic drivers, 80A-80D, with substantially parallel intended directions of motion. Positioned in each of opposing sides B and D, perpendicular to opposing sides A and C may be a passive radiator 82A and 82B positioned so the passive radiators have substantially parallel intended directions of motion.

Referring now to FIG. 11A-11G, there are shown an isometric view and six plan views of a baffle structure for use with the device of FIG. 10. The six plan views are taken in the direction of the corresponding arrow in FIG. 11A. To assist in visualization, the faces of the baffle structure are identified. Face identification reference designators with an "R" suffix refer to the reverse face of the correspondingly numbered face; for example, face "3R" is the reverse face of face 3. The baffle structure is configured to be placed inside the structure of FIG. 10 so that face 1 mates with the inside of side A, so that faces 4 and 7 mate with the inside of side B, face 14 (visible only in FIG. 11D) mates with the inside of side C, faces 10R and 11R mate with side D, face 13 mates with the inside of the top, and face 15 (visible only in FIG. 11G) mates with the inside of the bottom.

The baffle structure of FIGS. 11A-11G inserted as described above causes passive radiator 82A to be acoustically coupled to acoustic drivers 80B and 80C and to be acoustically isolated from acoustic drivers 80A and 80D.

Similarly, the baffle structure of FIGS. 11A-11G inserted as described above causes passive radiator 82B to be acoustically coupled to acoustic drivers 80A and 80D and to be acoustically isolated from acoustic drivers 80B and 80C. The acoustical coupling and isolation resulting from the baffle structure results in lessened likelihood of common mode vibration of passive radiators. Additionally, the two acoustic drivers, 80B and 80C that are acoustically coupled to passive radiator 82A are closest to opposing quadrants 82A-4 and 82A-2, respectively; two acoustic drivers, 80A and 80D, that are acoustically coupled to passive radiator 82B are closest to opposing quadrants 82B-2 and 82B-4, respectively, resulting in low pressure differential across the passive radiator surfaces. The passive radiators are therefore less likely to exhibit rocking motion, as discussed above in the discussion of FIG. 10A.

The baffle structure of FIGS. 11A-11G permits the use of several acoustic drivers and placement of the acoustic drivers and passive radiators in a small enclosure. For devices with fewer acoustic drivers, larger enclosures, and greater separation of the acoustic elements, simpler baffle structures implementing the principles of the invention may be used.

Figure 12:
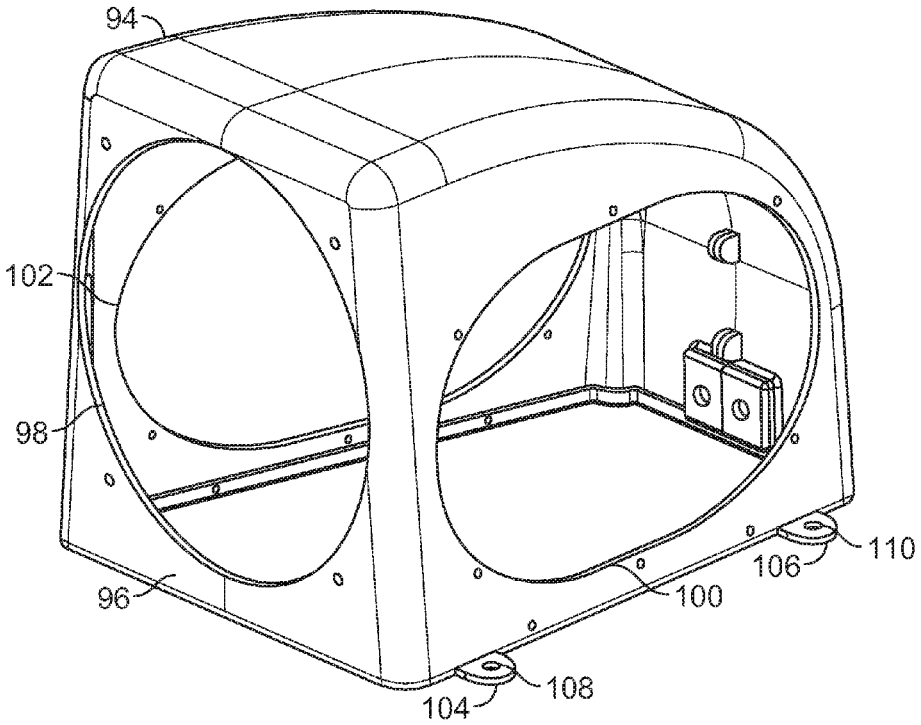
FIG. 12 is an isometric view of a audio device according to another aspect of the invention.

Referring now to FIG. 12, there is shown an acoustic enclosure illustrating another feature of the invention. Acoustic enclosure 94 has in a first wall 96 an opening 98 for an acoustic driver. In two opposing walls are openings 100, 102 for passive radiators. Acoustic enclosure 94 includes mounting elements such as ears 104, 106 with through holes 108, 110 for receiving mechanical fasteners, such as bolts, screws, or fasteners including deformable or deflectable protrusions. The acoustic enclosure may include additional mounting elements, such as additional ears, that are not visible in this view.

Acoustic enclosure 94 may made of plastic or some other suitable material. Driver opening 98 and passive radiator openings 100 and 102 are positioned so that the operation of an acoustic driver mounted in opening 98 results in radiating surfaces of passive radiators mounted in openings 100 and 102 vibrating, substantially out of phase with each other mechanically. The passive radiators mounted in openings 100 and 102 radiate acoustic energy to augment the acoustic energy radiated to the environment by the acoustic driver in opening 98. The acoustic driver and the passive radiators to be mounted in the enclosure are based on the acoustic, electrical, and mechanical requirements of the system, and the driver opening 98 and the passive radiator openings 100, 102 are dimensioned and shaped to accommodate the driver and passive radiator selected. In the implementation of FIG. 12, the passive radiator opening is shaped for a "racetrack" shaped passive radiator. Other implementations could have openings for different sizes and shapes of or more acoustic drivers and passive radiators. Other implementations could also have openings for additional acoustic drivers, and for other configurations of passive radiators that facilitate cancellation of mechanical vibration resulting from the operation of the passive radiators.

The mounting elements, such as ears 104, 106 provide for attachment to a structure, such as a structural component of a vehicle, holding the enclosure in place and preventing the "walking" problem that may occur with conventional acoustic devices. However, the mechanical attachment of a device containing vibrating components can cause vibration to be conducted from the device to the structural component. The conduction of vibration from the vibrating device to the structural component is undesirable and may require the use of vibration damping elements. However, an acoustic device that is designed so that structural vibration resulting from the operation of two passive radiators mutually cancel can lessen, simplify, or eliminate the need for vibration damping elements.

Figure 13A:
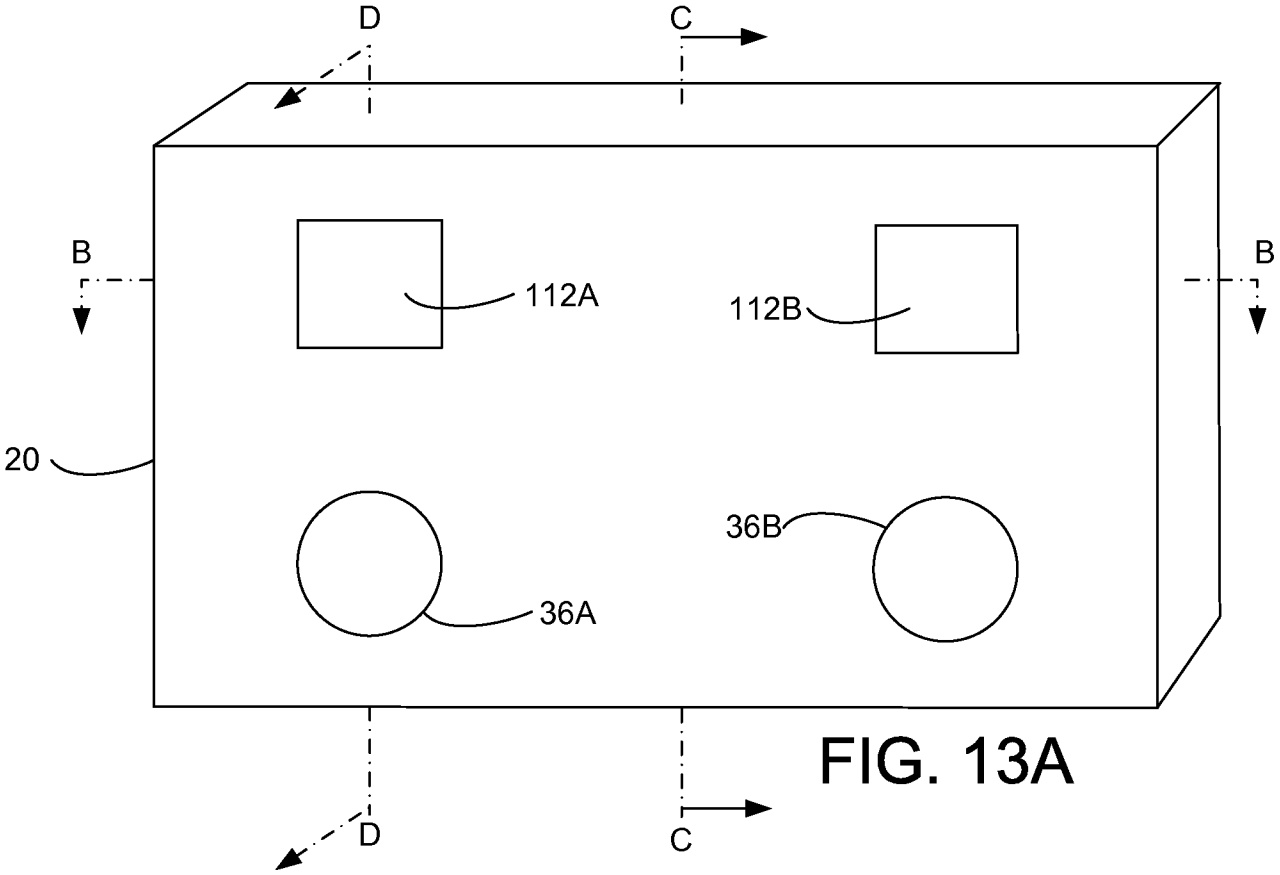
FIGS. 13A-13D are view of yet another audio device incorporating the invention.
Figure 13B:
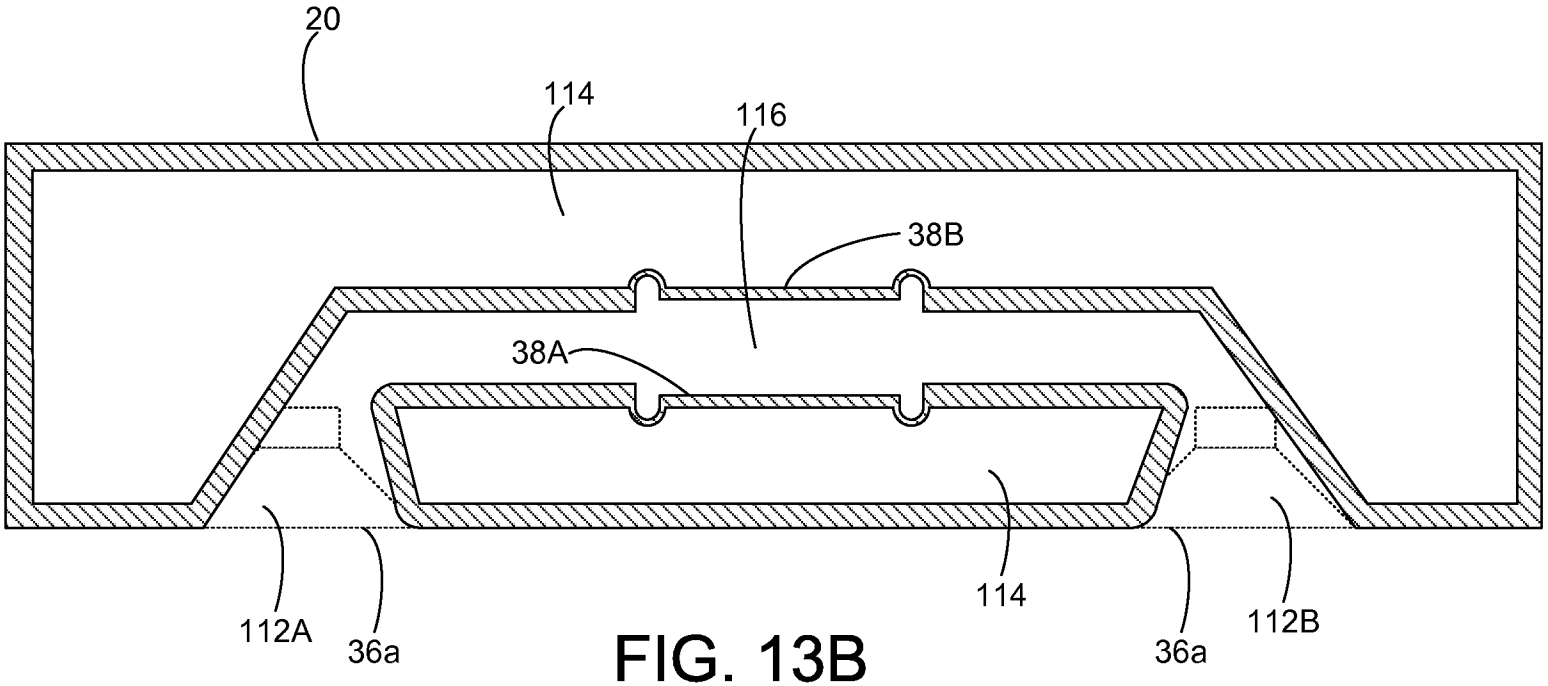
Figure 13D:
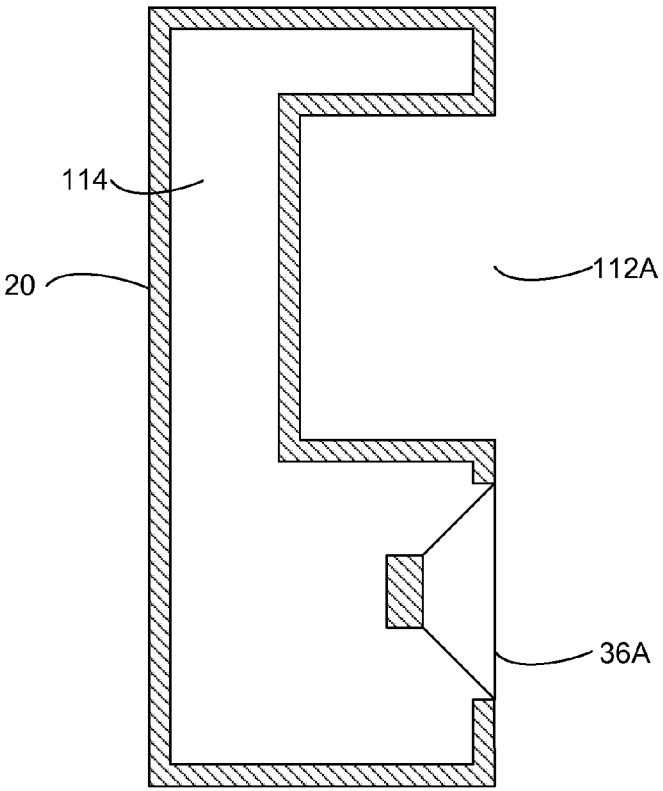
Figure 13C:
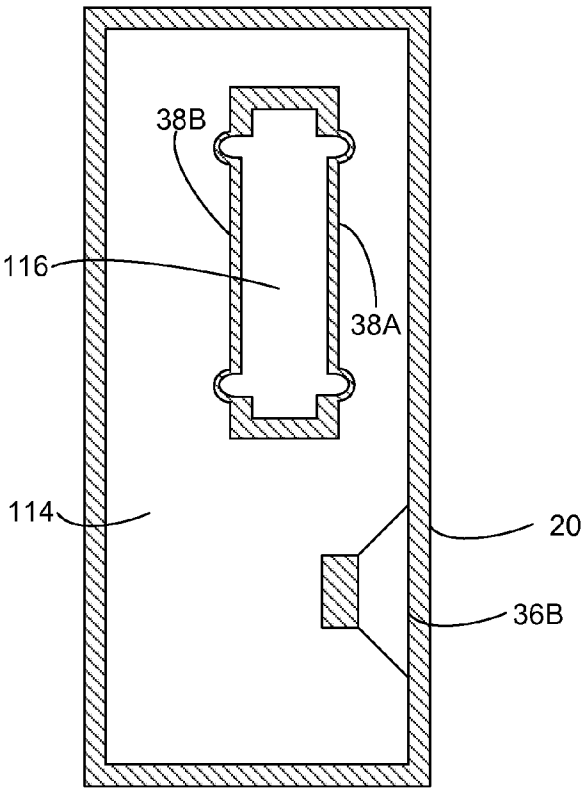

Referring now to FIGS. 13B-13D, there is shown another audio device incorporating the invention. The audio device includes one or more acoustic drivers 36A, 36B, mounted in an enclosure surface so that one radiating surface faces the exterior environment and so that one radiating surface faces into acoustic enclosure 20. In the enclosure 20, on the same surface of the enclosure as the acoustic drivers are acoustic outlets 112A and 112B, which will be explained more fully below.

FIG. 13B shows a cross-sectional view of the audio device of FIG. 13A, taken along line B-B of FIG. 13A. Inside enclosure are mounted two passive radiators 38A and 38B. On surface of the passive radiator is acoustically coupled to the interior 114 of the enclosure 20. A second surface of passive radiators 38A and 38B is acoustically coupled to a passage, which is acoustically coupled to outlets 112A and 112B through passageway 116.

FIGS. 13C and 13D are cross-sectional views taken along lines c-c, and d-d, respectively.

The elements of the audio device of FIGS. 13B-13D are similar to like named and numbered elements of the previous figures and perform similar functions in a similar manner. Passageway 116 may be dimensioned and configured so that it has minimal acoustic effect, or in other embodiments may be dimensioned and configured to act as an acoustic element, such as a port or waveguide. Outlets 112A and 112B may be covered by scrim or a grille that has minimal acoustic effect.

An advantage of the audio device of FIGS. 13B-13D is that the device can be thin relative to other embodiments. Thinness may be advantageous is situations such as for acoustic devices that are made to be hung on walls or acoustic devices that are designed to be fit into thin spaces, such as flat screen television cabinets or vehicle doors.

It is evident that those skilled in the art may now make numerous uses of and departures from the specific apparatus and techniques disclosed herein without departing from the inventive concepts. Consequently, the invention is to be construed as embracing each and every novel feature and novel combination of features disclosed herein and limited only by the spirit and scope of the appended claims.

What is claimed is:

1. An acoustic device, comprising, an acoustic enclosure bounded by a three dimensional bounding figure said enclosure having walls defining an enclosure interior volume, an acoustic driver having a first surface and a second surface, first and second surfaces radiating along a first axis, wherein said acoustic driver is mounted in said acoustic enclosure so that said first surface faces said enclosure interior volume, a cavity in said acoustic enclosure lying substantially within said bounding figure and comprising a cavity opening to an external environment, a first passive radiator having a first surface and a second surface and an intended direction of motion along a second axis, mounted in said acoustic enclosure so that said first passive radiator first surface faces said cavity and said passive radiator second surface faces said enclosure interior volume and, a second passive radiator having a first surface and a second surface and an intended direction of motion along a third axis, said second passive radiator mounted so that second passive radiator first surface faces said cavity and said second passive radiator second surface faces said enclosure interior volume, wherein said acoustic enclosure is constructed and arranged so that all acoustic paths between said acoustic driver first surface and said cavity includes at least one of first passive radiator and said second passive radiator.

2. An acoustic device in accordance with claim 1, wherein said second passive radiator is further mounted so that said first passive radiator intended direction of motion and said second passive radiator intended direction of motion are substantially parallel.

3. An acoustic device in accordance with claim 2 constructed and arranged so that operation of said acoustic driver causes vibration of said first passive radiator and said second passive radiator, said vibration of said first passive radiator and said second passive radiator radiating acoustic energy in phase into said cavity, said vibration resulting in inertial forces of said first passive radiator and said second passive radiator, wherein said first passive radiator and said second passive radiator are positioned so that a vector sum of said inertial forces of the first passive radiator and said second passive radiator is less than either of said inertial forces of said first passive radiator and said second passive radiator.

4. An acoustic device in accordance with claim 3 wherein said first and second passive radiators are constructed and arranged so that said vibration of said first passive radiator and said vibration of said second passive radiator are mechanically out of phase.

5. An acoustic device in accordance with claim 2, said acoustic driver having an intended direction of motion wherein said acoustic driver intended direction of motion is substantially parallel with at least one of said first passive radiator intended direction of motion and said second passive radiator intended direction of motion.

6. An acoustic device in accordance with claim 1 and further comprising an acoustic driver mounted in said acoustic enclosure so that said acoustic driver radiates acoustic energy into said interior volume, a plurality of passive radiators acoustically coupling said interior volume and said cavity, and wherein all acoustic paths from said acoustic driver through said interior volume to said cavity include at least one of said plurality of passive radiators.

7. An acoustic device comprising, an acoustic enclosure bounded by a three dimensional bounding figure, the enclosure having walls defining an enclosure interior volume, a cavity in the acoustic enclosure lying substantially within the bounding figure and separated from the interior volume, and comprising a cavity opening to an external environment, an acoustical driver mounted in the acoustic enclosure, the acoustic driver having a vibratile diaphragm for vibrating along a first axis to radiate acoustic energy, the diaphragm having a first radiating surface facing the exterior of the acoustic enclosure for radiating acoustic energy to the exterior and a second radiating surface constructed and arranged so that substantially all of the second radiating surface faces the interior volume for radiating acoustic energy into the acoustic volume, a first passive radiator acoustically coupling the interior volume and the cavity, the first passive radiator comprising a first vibratile diaphragm, and a second passive radiator acoustically coupling the interior volume and the cavity, the first passive radiator comprising a second vibratile diaphragm, the first and second vibratile diaphragms constructed and arranged to vibrate along a second axis responsive to the acoustic energy radiated into the interior volume to radiate acoustic energy into the cavity.

8. An acoustic device in accordance with claim 7 wherein the first axis and the second axis are parallel.

9. An acoustic device in accordance with claim 2, wherein said acoustic device is constructed and arranged so that said first passive radiator and said second passive radiator vibrate mechanically out of phase responsive to said acoustic energy radiated into said interior volume by said acoustic driver.

10. An acoustic device in accordance with claim 9, wherein said second axis and said third axis are coincident.

11. An acoustic device in accordance with claim 10 wherein said coincident second and third axes are parallel with said first axis.

12. An acoustic device in accordance with claim 2 wherein said second axis and said third axis are parallel with said first axis.

* * * * *